US008550171B2

(12) United States Patent
Wajnikonis et al.

(10) Patent No.: US 8,550,171 B2
(45) Date of Patent: Oct. 8, 2013

(54) FLEXIBLE HANG-OFF ARRANGEMENT FOR A CATENARY RISER

(75) Inventors: Krzysztof J. Wajnikonis, Houston, TX (US); Steven John Leverette, Richmond, TX (US)

(73) Assignee: Seahorse Equipment Corp., Houston, TX (US)

( * ) Notice: Subject to any disclaimer, the term of this patent is extended or adjusted under 35 U.S.C. 154(b) by 55 days.

(21) Appl. No.: 12/850,759

(22) Filed: Aug. 5, 2010

(65) Prior Publication Data

US 2010/0294504 A1 Nov. 25, 2010

Related U.S. Application Data

(60) Continuation of application No. 12/564,622, filed on Sep. 22, 2009, which is a division of application No. 11/861,080, filed on Sep. 25, 2007, now abandoned.

(51) Int. Cl.
*E21B 7/12* (2006.01)

(52) U.S. Cl.
USPC ..... 166/355; 166/359; 166/346; 166/354

(58) Field of Classification Search
USPC ... 166/367, 359, 343, 345; 405/224.2–224.4, 405/169, 195.1, 265, 168.1; 403/122–144
See application file for complete search history.

(56) References Cited

U.S. PATENT DOCUMENTS 3,189,098 A 6/1965 Haeber
3,461,916 A 8/1969 Ledgerwood, Jr.
3,701,551 A 10/1972 Morgan
3,718,183 A 2/1973 Scott
3,913,668 A 10/1975 Todd et al.
4,067,202 A 1/1978 Reed
4,127,145 A 11/1978 Erlenmayer et al.
4,137,948 A 2/1979 Van Heijst
4,165,108 A 8/1979 de Saint-Palais
4,279,544 A 7/1981 Brun et al.
4,311,327 A 1/1982 Ortloff et al.
4,348,137 A 9/1982 Tuson et al.
4,362,215 A * 12/1982 Sparks ..... 166/367
4,398,331 A 8/1983 Inao
4,456,073 A 6/1984 Barth et al.
4,529,334 A 7/1985 Ortloff
4,630,681 A 12/1986 Iwamoto
4,808,034 A * 2/1989 Birch ..... 405/195.1
4,915,416 A 4/1990 Barrett et al.
5,269,629 A 12/1993 Langner
5,437,518 A * 8/1995 Maloberti et al. ..... 405/169
5,447,392 A 9/1995 Marshall
5,553,976 A 9/1996 Korsgaard
5,615,977 A 4/1997 Moses et al.
5,702,205 A 12/1997 Mahone et al.

(Continued)

*Primary Examiner* — Matthew Buck
*Assistant Examiner* — Aaron Lembo
(74) *Attorney, Agent, or Firm* — Wong, Cabello, Lutsch, Rutherford & Brucculeri, LLP.

(57) ABSTRACT

Flexible hang-off arrangement is provided for a catenary riser suspended from an offshore or inshore platform, which includes floating or fixed platforms, vessels or/and buoys. The bending loads in the top segments of the said riser are reduced by incorporating a pivot at the riser hang-off. Pressure containing welded, bolted, rolled or swaged pipe spools transfer fluids, including hydrocarbons between the riser and the platform. Along significant spool lengths the tangents to the center lines of said spools are orthogonal to and offset from the tangent to the center line of the riser at the hang-off. The said pressure containing spools include arbitrary looped, spiral and helicoidal designs that are subject to torsion.

29 Claims, 29 Drawing Sheets

(56) References Cited

U.S. PATENT DOCUMENTS

| | | | | |
|---|---|---|---|---|
| 6,062,769 | A | 5/2000 | Cunningham | |
| 6,213,215 | B1 | 4/2001 | Breivik et al. | |
| 6,558,084 | B2 * | 5/2003 | Moog et al. | 405/224 |
| 6,739,804 | B1 | 5/2004 | Haun | |
| 7,104,329 | B2 | 9/2006 | Kleinhans | |
| 7,163,062 | B2 * | 1/2007 | Sele | 166/367 |
| 7,373,986 | B2 | 5/2008 | Pollack et al. | |
| 7,946,790 | B2 * | 5/2011 | Casola et al. | 405/169 |
| 8,016,520 | B2 * | 9/2011 | Dybvik et al. | 405/224 |
| 2004/0031614 | A1 | 2/2004 | Kleinhans | |
| 2008/0214072 | A1 | 9/2008 | Saint-Marcoux | |
| 2010/0006300 | A1 * | 1/2010 | Wajnikonis et al. | 166/345 |

* cited by examiner

FLEXIBLE HANG-OFF ARRANGEMENT FOR A CATENARY RISER

CROSS-REFERENCE TO RELATED APPLICATIONS

This application is a continuation of U.S. patent application Ser. No. 12/564,622 filed Sep. 22, 2009, which is a divisional of U.S. patent application Ser. No. 11/861,080 filed Sep. 25, 2007. The disclosures of these applications are hereby incorporated in their entireties by reference.

STATEMENT REGARDING FEDERALLY SPONSORED RESEARCH OR DEVELOPMENT

Not Applicable

BACKGROUND OF THE INVENTION

1. Field of the Invention

This invention relates to offshore structures and the risers used to connect such structures to undersea wells, pipelines and the like. More particularly, it relates to catenary risers, including steel catenary risers (SCR's) and catenary risers constructed from other materials like titanium, and the apparatus used to attach a catenary riser to and support a catenary riser from a floating (or fixed) offshore structure.

2. Description of the Related Art Including Information Disclosed Under 37 CFR 1.97 and 1.98

The top end of a riser, including a catenary riser and including a Steel Catenary Riser (SCR), is typically suspended from a platform (floater, vessel, platform, including a Tension Leg Platform—TLP, spar, buoy, etc) or a platform supported on the seabed (jacket platform, compliant tower etc.). All types of floating structures are referred to herein as floaters. For example, FIG. 1 depicts an SCR suspended from a truss spar floater.

Floaters move about their mean design positions (surge, sway and heave) as well as change their angular orientation with regard to their mean position (pitch, roll and yaw). FIG. 1*b* illustrates an example of the combined surge and pitch or sway and roll motions of a floater have on the geometry of a catenary riser, which in particular can be an SCR.

The floater motions outlined above are the result of static, dynamic, aerodynamic and hydrodynamic interactions between the floater on its mooring, currents, wind and waves. What is of particular interest here are those interactions that result in large translational and angular offsets of the floater from its mean design positions, like those the example of which is shown in FIG. 1. Those large offsets have typically static and dynamic components. Static offsets are caused by mean currents and winds, while large time variable offsets are caused by dynamic interactions of the floater on its mooring with low frequency wave drift forces and with wind gusts. The low frequency floater motions occur typically with periods of the order of hundreds of seconds. The largest amplitudes of those motions occur where resonance takes place between the fluid dynamic forcing, like wave drift forces or/and wind gust forces, and the vessel mooring. The vessel moored can typically be approximated in each of the 6 degrees of freedom as a damped mass-spring system, whereas the motions for individual degrees of freedom can be fairly independent, or static and/or dynamic couplings can exist between degrees of freedom. These static and dynamic couplings are represented by the existence of non-zero off-diagonal terms in the stiffness and mass matrices of the dynamic system, respectively.

In addition to mean and low frequency motions floaters are also subject to so called first order dynamic motions caused by the floater responses to waves. These motions occur at the wave frequencies, i.e. with periods from a few to a few dozens seconds. For large offshore floaters the motion amplitudes of the said first order motions tend to be smaller than the static and dynamic offsets caused by the mean forces and the low frequency forces.

For simplicity, the floaters are approximated herein as rigid bodies, while the geometries of slender structures such as the risers adjust to the translational and angular offsets of the floater. Riser changes the angles both statically and dynamically due to movements of the hang-off point and due to direct forcing and response of riser to wave and current forces.

In particular, the variation in the relative angle between any orientation on the floater and that of the axis of the riser at the hang-off is of interest herein. The said relative angular floater/riser offsets can result in high bending loads (and stresses), while the translational and combined translational and angular offsets can result in high variations in the effective tensions at the riser hang-offs.

In those cases wherein SCR motions and the said relative angular offsets at the SCR hang-off are not very large, the riser stress variations due to the changes in the said angular offsets and effective hang-off tensions can sometimes be mitigated by adding stress and/or tapered transition joints at the SCR hang-off. These can utilize steel materials, or for larger offsets and stresses titanium alloys can be used. Titanium alloys tend to have higher allowable strains than most typical steel materials used offshore and their Young's Moduli tend to be lower than those of steels. Both the above characteristics of titanium alloys are beneficial for tolerating high angular and translational floater offsets in comparison with the corresponding characteristics of steels.

Materials that are more flexible than steel, like for example Fiber Reinforced Plastics (FRP), can also be used.

In a conventional suspension of the top of an SCR the bending stresses in the SCR are reduced by using a flexjoint, see for example U.S. Pat. No. 5,269,629 (Langner). The use of flexjoints may be combined with the use of tapered or stepped stress joint, etc., which for similar offsets tend to be shorter and have smaller diameters than those required when no flexjoint is used.

A flexjoint comprises flexible (rubbery) elastomeric components that 'absorb' the angular deflections. By the said 'absorbing', it is meant that most of the bending required occurs by deforming the flexible elastomeric components of the flexjoint thus reducing the amount of bending and the said bending stresses in the metal components of the SCR system. It is noted that elastomeric components of a flexjoint are subjected to pressure and surface action of internal components. Both said pressure action and physical and/or chemical surface action may limit the use of flexjoints in particular due to high pressures, due to thermal, erosive, corrosive, etc. action(s) of internal fluids.

Whenever the said flexjoints and/or said stress joints are used as primary means of reducing bending loads, the effective tension and the bending moment at the hang-off are transmitted to the structure of the floater. These loads do not exert much load on the piping above the flexjoint or stress joint.

Another solution of an SCR hang-off is shown in U.S. Pat. No. 6,739,804 (Haun), which instead of a flexjoint utilizes a universal joint. Unlike with a flexjoint or a stress joint, the said angular offsets are transferred to a pipe spool system above the universal joint. In Haun's design, the spools are provided with piping swivels that allow relative rotations of adjoining segments of the spools, and thus bending and torsional loads and stresses are reduced to relatively small, residual values.

In particular:

Flexjoints are expensive and the maximum SCR pressures are limited; they also allow limited angular deflections.

Flexjoints require the elastomeric material to be exposed to riser contents and pressure.

Piping swivels are subject to leaks, have limited pressure ratings and also may require complicated guiding systems to reduce spool bending on the piping swivels.

At this time, there is little use of torsional deflection in design for the purpose of stress relieving in offshore pipeline or riser systems. Rigid subsea jumper pipes and pipe expansion spools sometimes incorporate loops, including square loops; 'L' or 'Z' shapes in order to deal with thermal expansion of pipelines laid on the seabed. The thermal expansion load relief is through increasing bending, shear and in some of these designs also torsional flexibility of the jumper. However, these designs typically see little torsion that is typically incidental to axial and transverse loading of those subsea jumpers that have three-dimensional (3-D) shapes.

There are some patent references to the use of spiral, helicoidal or coil designs and/or some pivoting arrangements in offshore engineering, but those designs are not in widespread use and they do not involve catenary risers. Examples include: U.S. Pat. Nos. 3,189,098, 3,461,916, 3,701,551, 3,718,183, 3,913,668, 4,067,202, 4,137,948, 4,279,544, 4,348,137, 4,456,073, 4,529,334, and 7,104,329.

Catenary riser pipes routinely see limited torque loading that is incidental to any combination of 3-D bending, shear and tension load. Torsional stresses in the catenary risers due to the said torques are usually small in comparison with other loads.

The torsional flexibility of axi-symmetrical members is, however, utilized in mechanical engineering. For example, torsion rods have been used as wheel springs in the suspension of many successful automobiles throughout the twentieth century until now. These do not need to have large dimensions in order to accommodate significant vertical movement of a wheel required that is translated to the torsion of the 'wheel end' of the rod.

SUMMARY OF THE INVENTION

The suspension of the said top of the riser, including a catenary riser, including a Steel Catenary Riser is by means of a pivoting arrangement. The riser can be suspended from a riser porch, a riser bank, a turret of a Floating Production Storage and Offloading (FPSO) vessel, Floating Production Storage (FPS) vessel, buoy, I-tube, J-tube, hawse pipe, fairlead, chute, etc.

The said pivoting arrangement may utilize a ball joint, a universal joint, a flexjoint, any plurality of or any combination of shackles, chain links, etc, including a single shackle and a single chain link, a bellmouth, a chute, an entry or exit to/from an I-tube or/and J-tube or/and a hawse pipe that might or might not incorporate a bellmouth, a fairlead, a pulley, any arbitrary line re-directing device, etc. In cases where a flexjoint is used, its design could be simpler than that shown by Langner. In this design the elastomeric components of the flexjoint would typically be arranged external to the pressure containing part of the piping, thus considerably simplifying the design.

The said pivoting arrangement resists the tension in the SCR and it also resists any transverse forces on the top of the SCR that is suspended from the pivot. However, the pivoting arrangement allows the top part of the SCR to undergo angular deflections relative to the said platform, the said floater, the said jacket, the said compliant tower, etc. SCRs are often referred to herein for brevity, because the SCRs are the most widely used rigid catenary risers. However, whenever the words 'Steel Catenary Riser' or their abbreviation 'SCR' are used herein, any type of rigid catenary riser is meant. This is because, any other metallic, non-metallic, composite, etc. riser that has higher bending stiffness than a flexible riser, can be substituted for an SCR in any implementation of this invention.

The said angular deflections include deflections in plane and out of plane of the SCR. Torsional angular deflections of the SCR at the pivot may or may not be partly or totally resisted by the pivot (in other words torsional deflections of the SCR at its hang-off are immaterial to the designs of interest herein).

Unlike any of the prior art above, this design comprises pipe components that are typically all fixed to each other by means of welding, using bolted flanges, connectors, swaging, etc., which can tolerate higher pressures and are often more cost efficient than the said prior art designs.

In the designs according to this invention, the spools are arranged in geometrical figures, whereas the axes of the spools (straight, bent or curved) are offset from and have tangents that form large angles with the tangent to the top joint of the SCR at the hang-off. By large angles in particular right angles and angles close to right angles are meant. The said tangent lines of the spools that are close to being orthogonal to the SCR axis at the hang-off would in general not lie in the same planes, but in some cases may lie in the same planes.

The said spools can form continuous segmented lines, can be arranged in loops and/or coils and/or spirals and/or helices, so that the bending of the top part of the SCR is transformed mostly to torsion in the spools. However, some residual bending and other than torsional shear load can still be present in the spool system.

Example implementations of this invention featuring example spiral spool arrangements are depicted in FIGS. 2 through 10.

The said novel designs utilize relatively low torsional stiffness of a pipe that allows high angles of twist without generating high torsional stresses. The arbitrary level of the in-plane and out-of-plane rotational flexibilities of the spool system required are achieved by adjusting the lengths of the spool segments and/or by adjusting the diameters or side lengths of the said loops or/and spirals. The said in-plane and out-of-plane rotational flexibilities of the spool system required are also adjusted by selecting required number of spool segments, loops or turns in the spirals as well as by using spool geometries that are featured by spool axes being close to perpendicular to the riser axis at the hang-off. In agreement with the generalized Hooke's Law, the longer the said dimensions and the higher the said numbers of coil turns, loop turns and/or spiral turns the more flexible is the system.

Typically, but not necessarily, any straight or segmented lines may be merged by bends that would have specified their minimum radii of curvature. Typical radii of curvature of bends used in pipeline engineering include three times (3D bends) and five times (5D bends) the nominal diameter of the pipe. However, in some designs different bent radii are used.

In particular, the 5D bends are standard bends for pigable risers and pipelines, accordingly bends of 5D or greater radii would be most likely utilized in riser spool systems. However, not all riser systems need to be pigable and any standard or not standard bent radius, could be used, including 0D [zero-D], for sharp joints between straight or curved pipe segments.

Finite Element Analysis (FEA) demonstrates that, even with very high pressures in the piping and large maximum deflection angles, the said novel system can be designed with a limited number of turns in the coil or even an incomplete 360° loop, in the coil, spiral, helix, etc. This also includes different shapes of the spool system that could have similar effective lengths subjected to increased torsion. In such designs the risers could be provided with an optional tapered or stepped stress joints on the riser and/or spool sides of the pivot. These would see only relatively limited bending and acceptable bending stresses.

Increasing the diameter(s) and/or the side length(s) of the segmented spool line(s) of the loop(s) and/or spiral(s) and/or increasing the number of segments and/or loops and/or turns in a spiral makes the spool system more flexible. For the same maximum top SCR deflection angle, a greater flexibility of the spool system decreases both bending stresses in the top segment of the SCR and it also decreases torsional stresses in the spools. Or alternatively, an increased flexibility in the spool system allows a greater variation in the maximum SCR hang-off deflection angle. The said greater flexibility of the spool system can be utilized both to reduce quasi static and dynamic bending stresses in the catenary riser. In particular, greater rotational flexibility helps to reduce that part of bending stresses (and to increase the corresponding fatigue life), that would otherwise be transferred to the riser from the moving platform or vessel.

The designs according to this invention that include pivot points at or close to the effective center of the loop(s) or spiral(s) result in minimum stresses in the spool system. This is because such geometries minimize the residual bending and shear loads in the spool system (both non-torsional and torsional shear). The optimum pivot locations can be determined more accurately for any deflected riser-spool system geometry using well known structural engineering methods.

Examples of designs featuring the effective pivot locations close to the optimum locations are shown in FIGS. 2 through 7.

However, other solutions incorporating pivots at other locations are also feasible, even though they result in higher stresses for the same riser forces and deflection angles and similar spool system geometry, see for example FIGS. 8 through 10. Such other designs might be more convenient because they might allow a better access to the pivot and/or they allow more freedom in geometrical arrangement of system components. The reasons for geometrical variations could be multiple: simplicity of the system, access to other components, ease of installation, ease of servicing or structural examination, etc.

Optionally, piping swivel(s) in the spools can also be included in the novel designs.

BRIEF DESCRIPTION OF THE SEVERAL VIEWS OF THE DRAWING(S)

FIG. 1*a* presents a typical catenary riser suspended from a truss spar floater. An example of effects of the spar offsets on the riser geometry is illustrated in FIG. 1*b*.

Figure 7A:
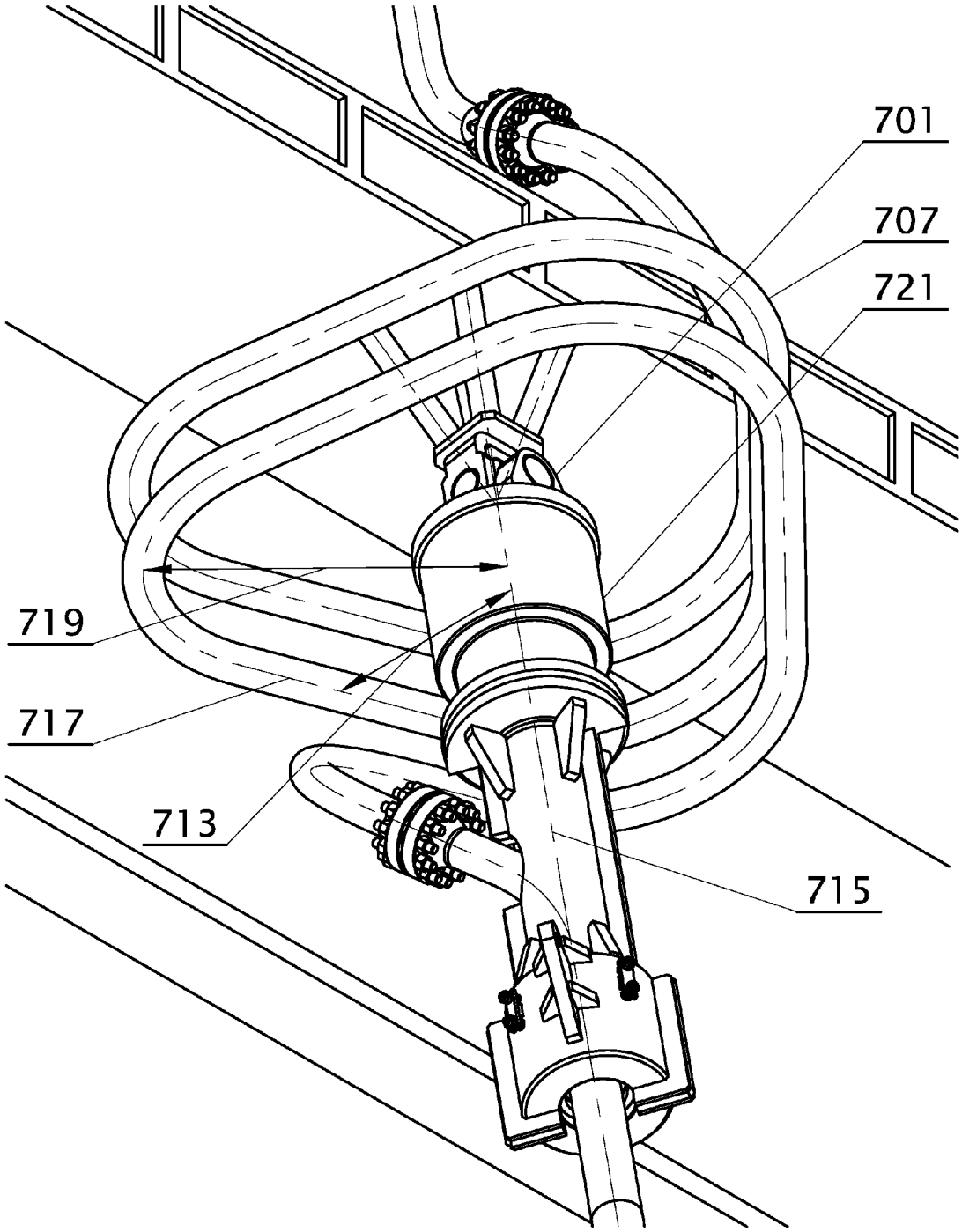
Figure 7B:
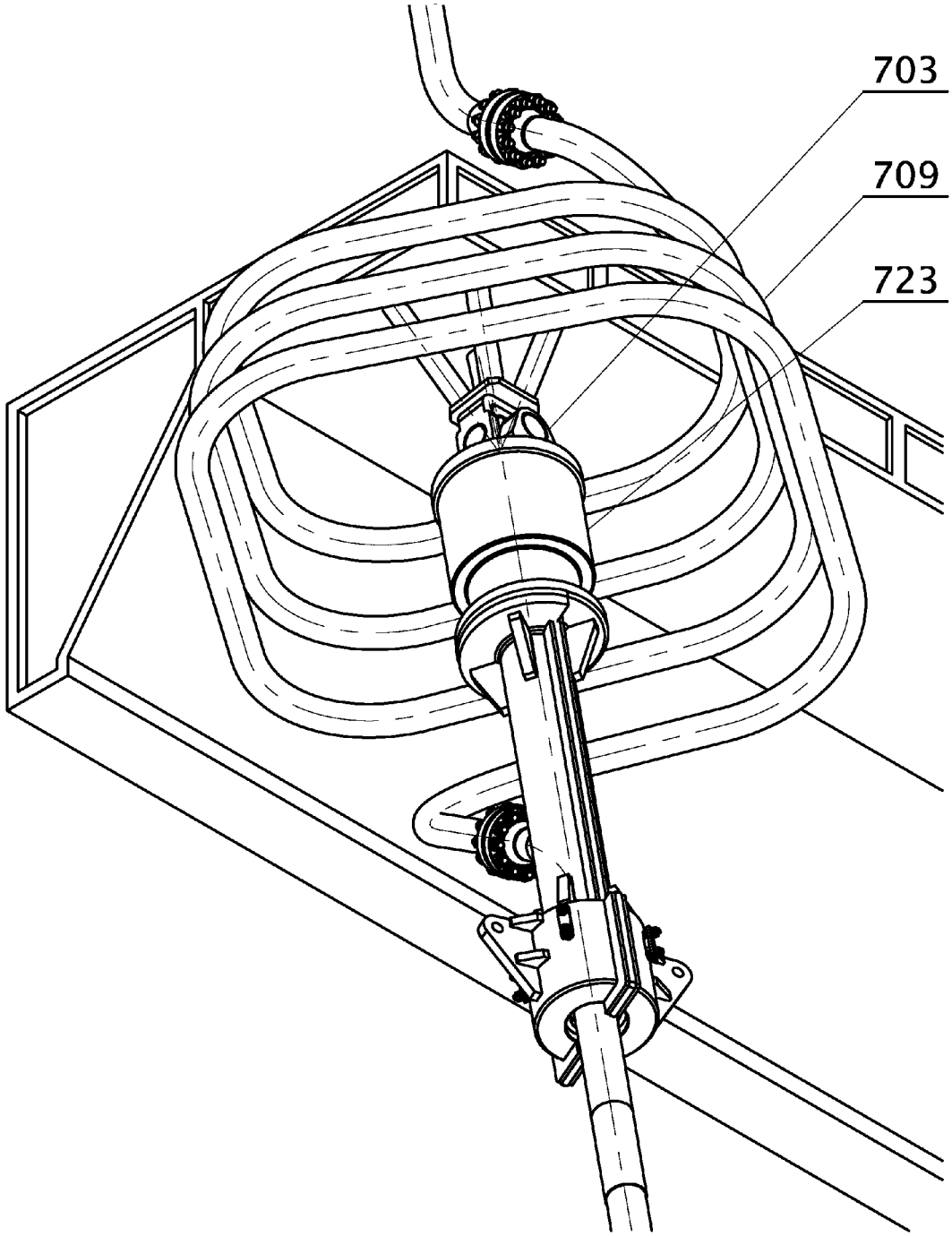
Figure 7C:
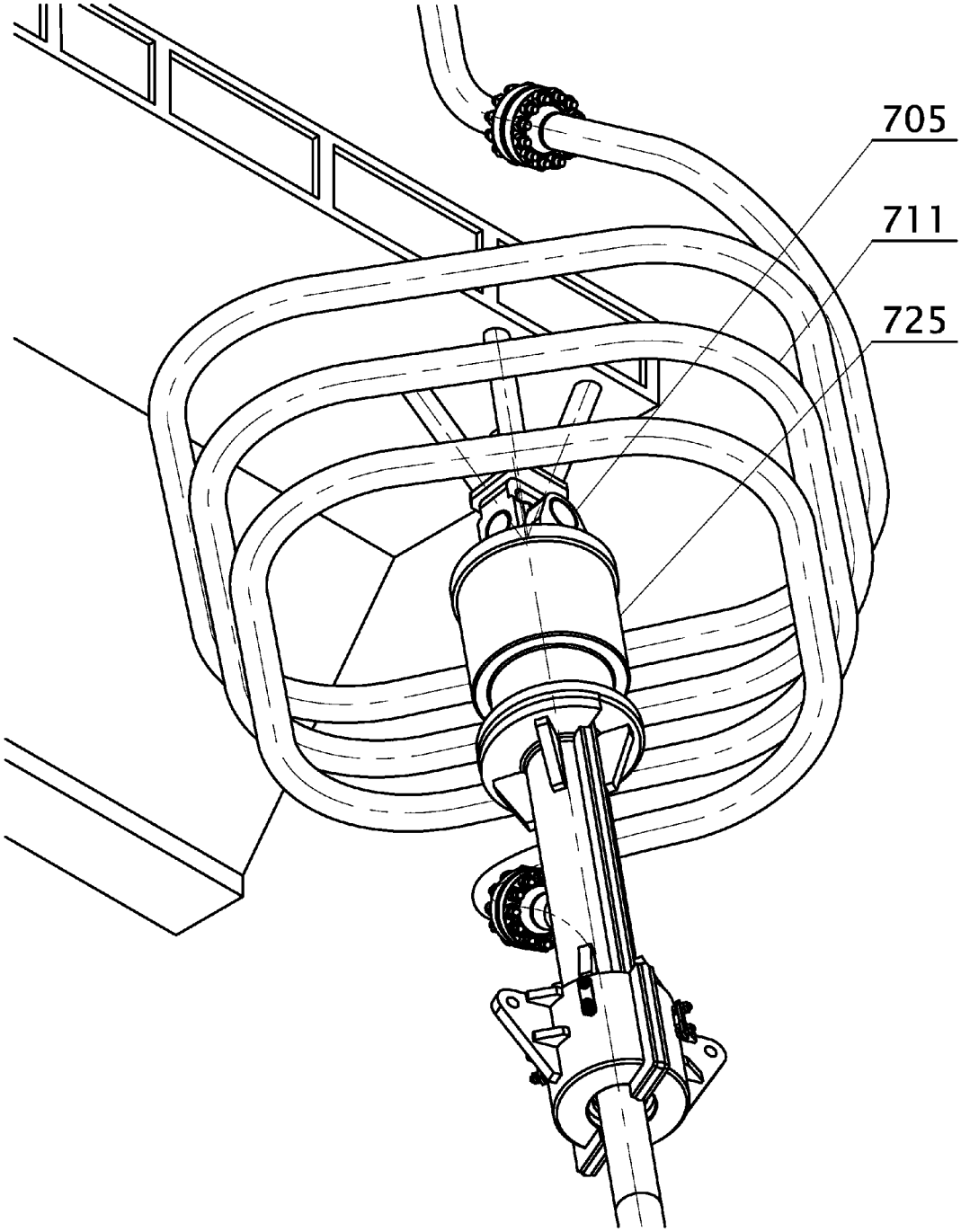

FIG. 7 depicts pivot-spool arrangements utilizing universal joints as pivots located close to the centers of spirals. FIG. 7*a* features a triangular spiral spool and FIG. 7*b* features a pyramidal spiral spool with the pyramid shape narrowing upwards. FIG. 7*c* features a pyramidal spiral spool with the pyramid shape narrowing downwards.

Figure 8:
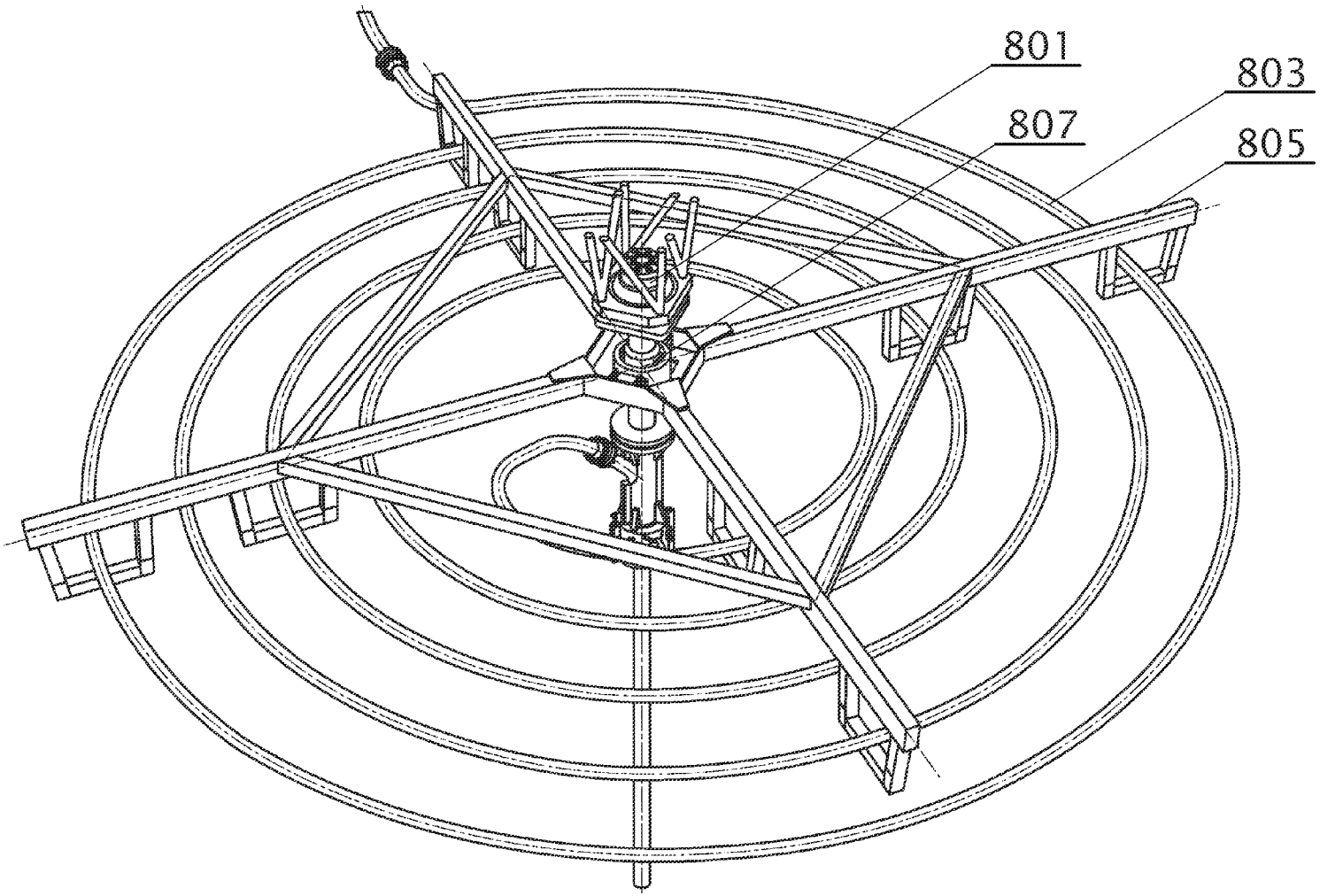

FIG. 8 depicts a pivot-spool arrangement utilizing a flexjoint as a pivot located above the center of a planar (flat) spiral. The circular spiral spool is supported with a 4 leg beam frame.

Figure 9A:
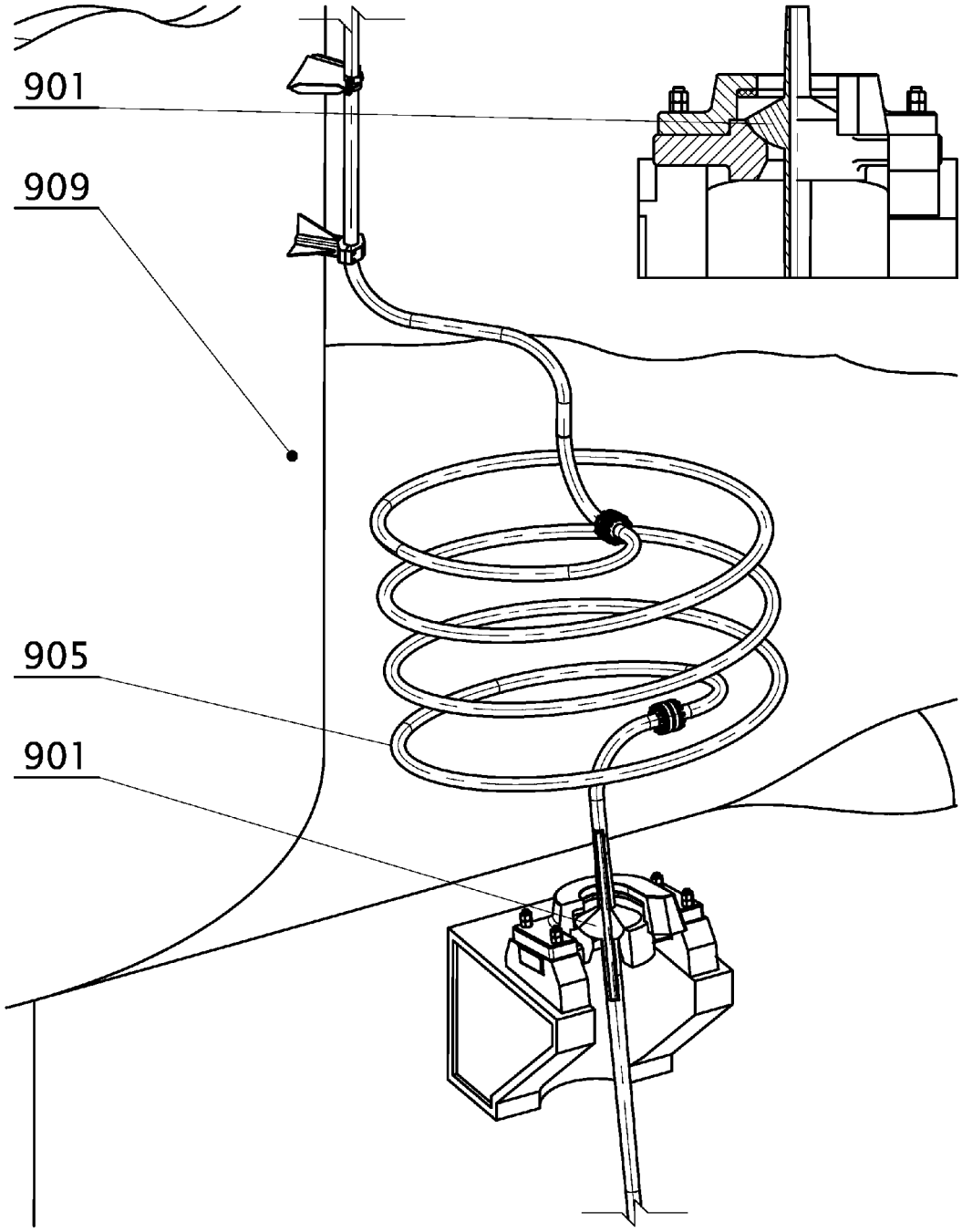
Figure 9B:
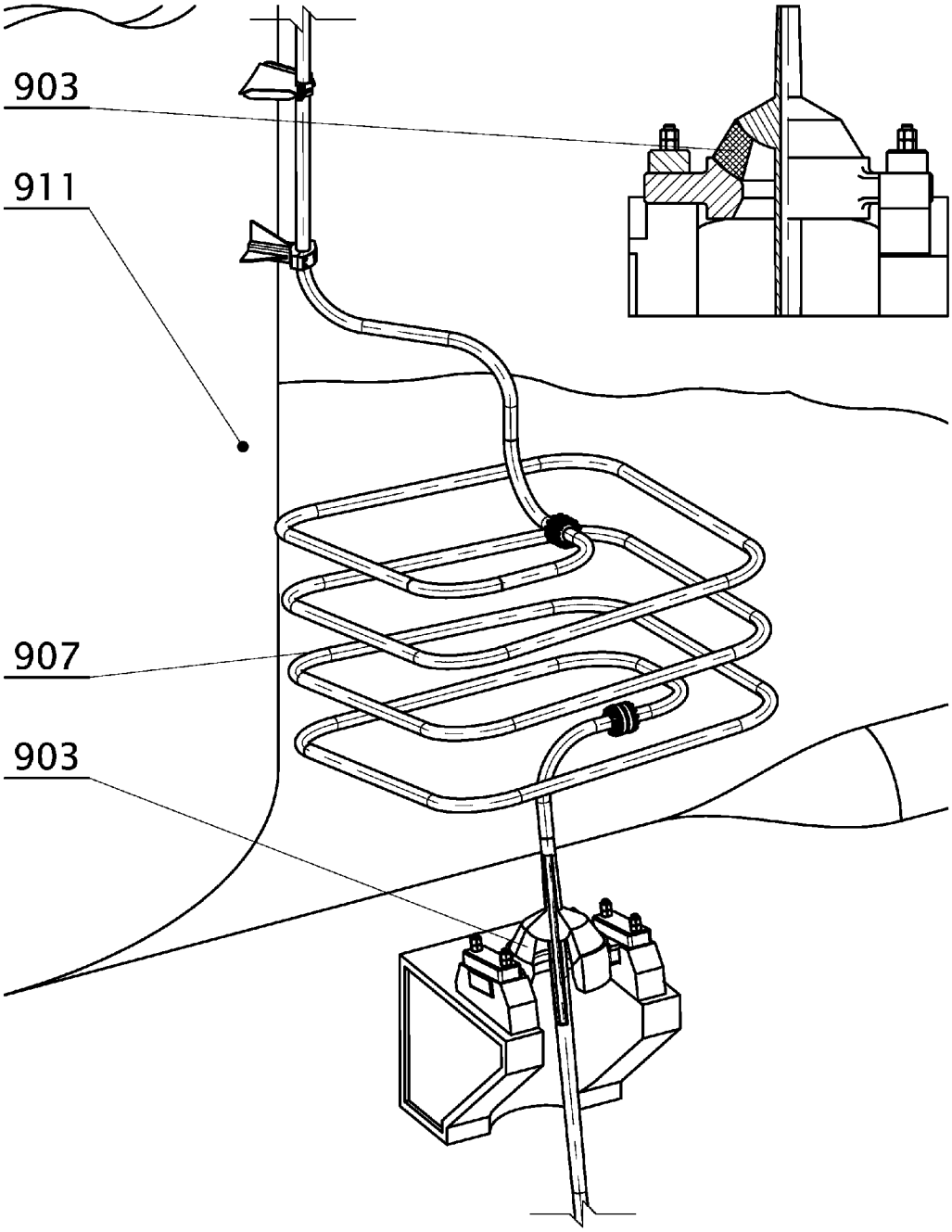

FIG. 9 depicts a pivot-spool arrangement featuring progressive spirals offset to locations above the pivot. FIG. 9*a* features a ball joint and a circular spiral spool and FIG. 9*b* features a flexjoint and a quadrangular spiral spool.

Figure 10A:
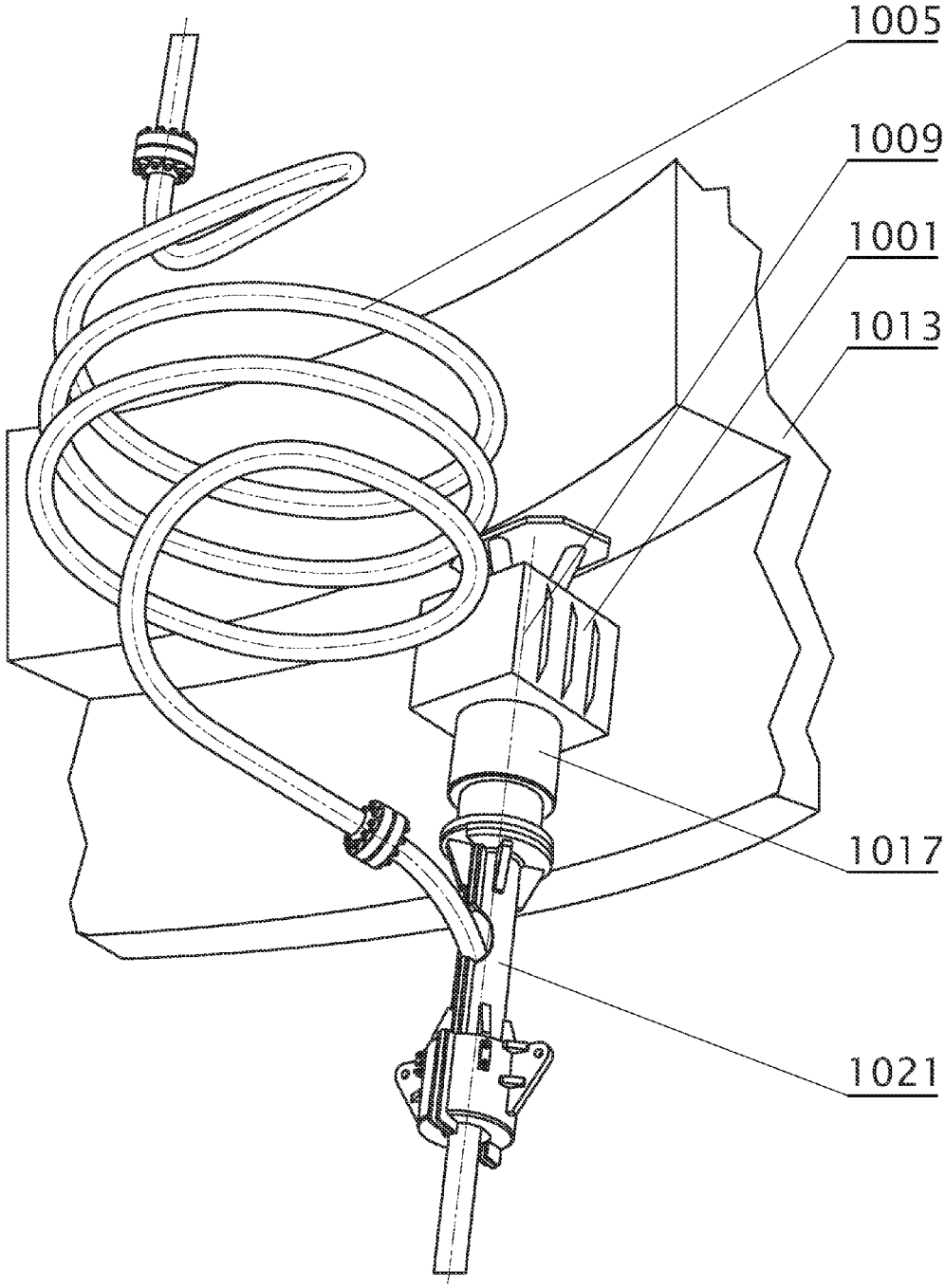
Figure 10B:
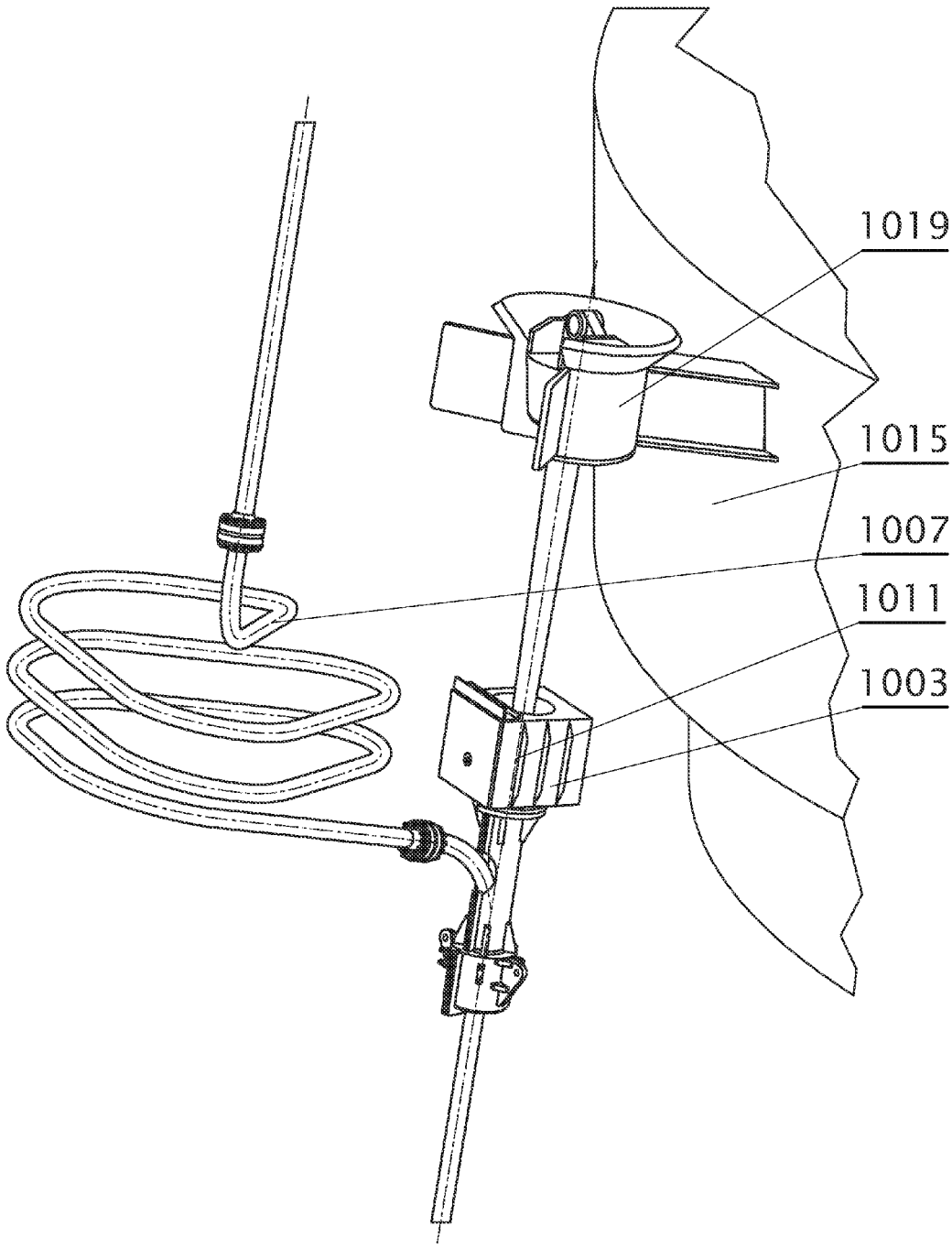

FIG. 10 depicts pivot-spool arrangements featuring ball joints as pivots and progressive spirals offset approximately horizontally with regard to the locations of the pivots, suspended from turrets of an FPSO or an FSO. FIG. 10*a* features a circular spiral spool and FIG. 10*b* features a triangular spiral spool.

FIG. 11 depicts example details of an SCR hang-off clamp assembly design similar to those utilized in the designs depicted in FIGS. 2 through 10 and other example details.

Figure 11A:
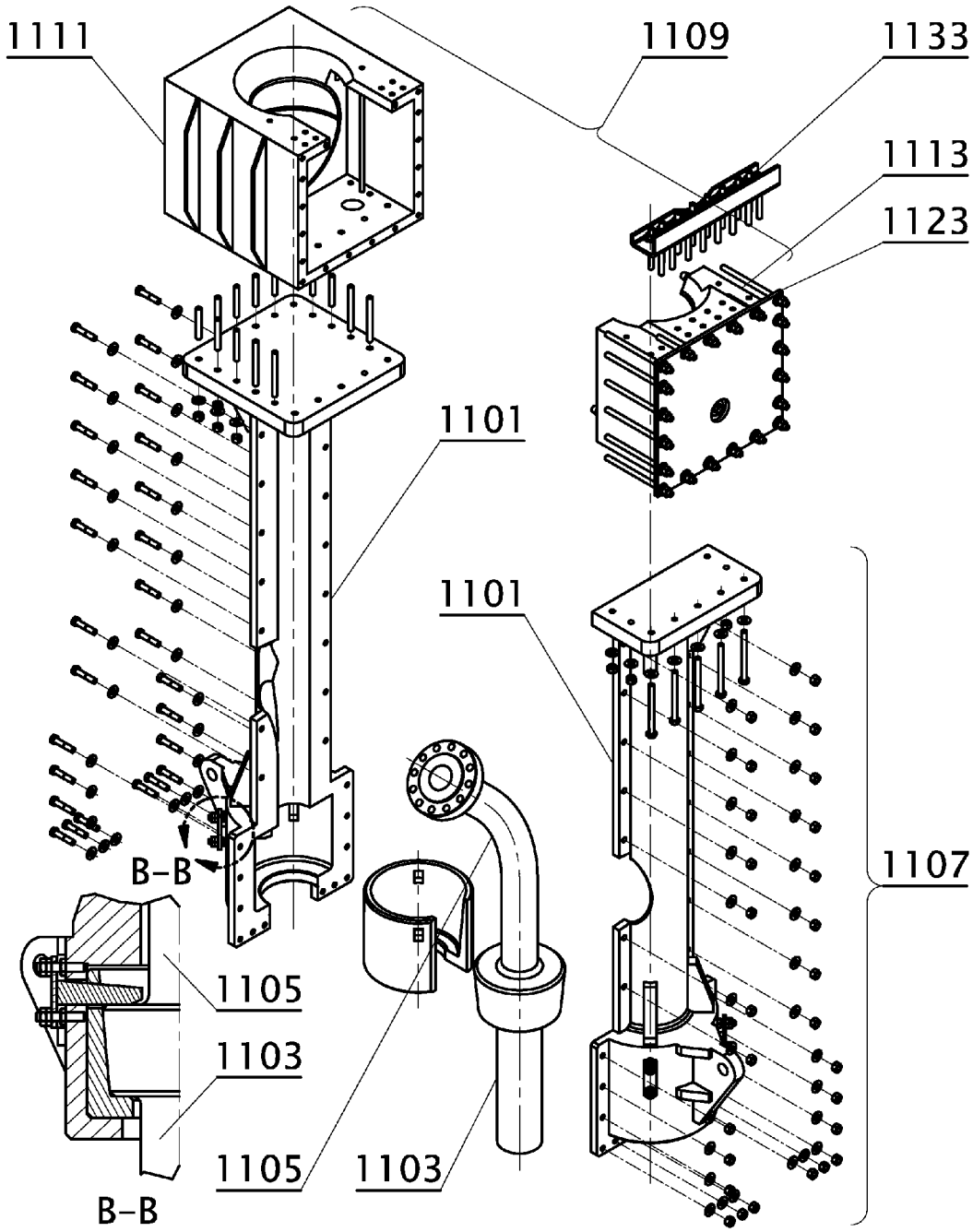

FIG. 11*a* depicts an example SCR stress joint-gooseneck arrangement. FIG. 11*a* also depicts an exemplary hang-off clamp design utilizing a ball joint assembly as a pivoting arrangement.

Figure 11B:
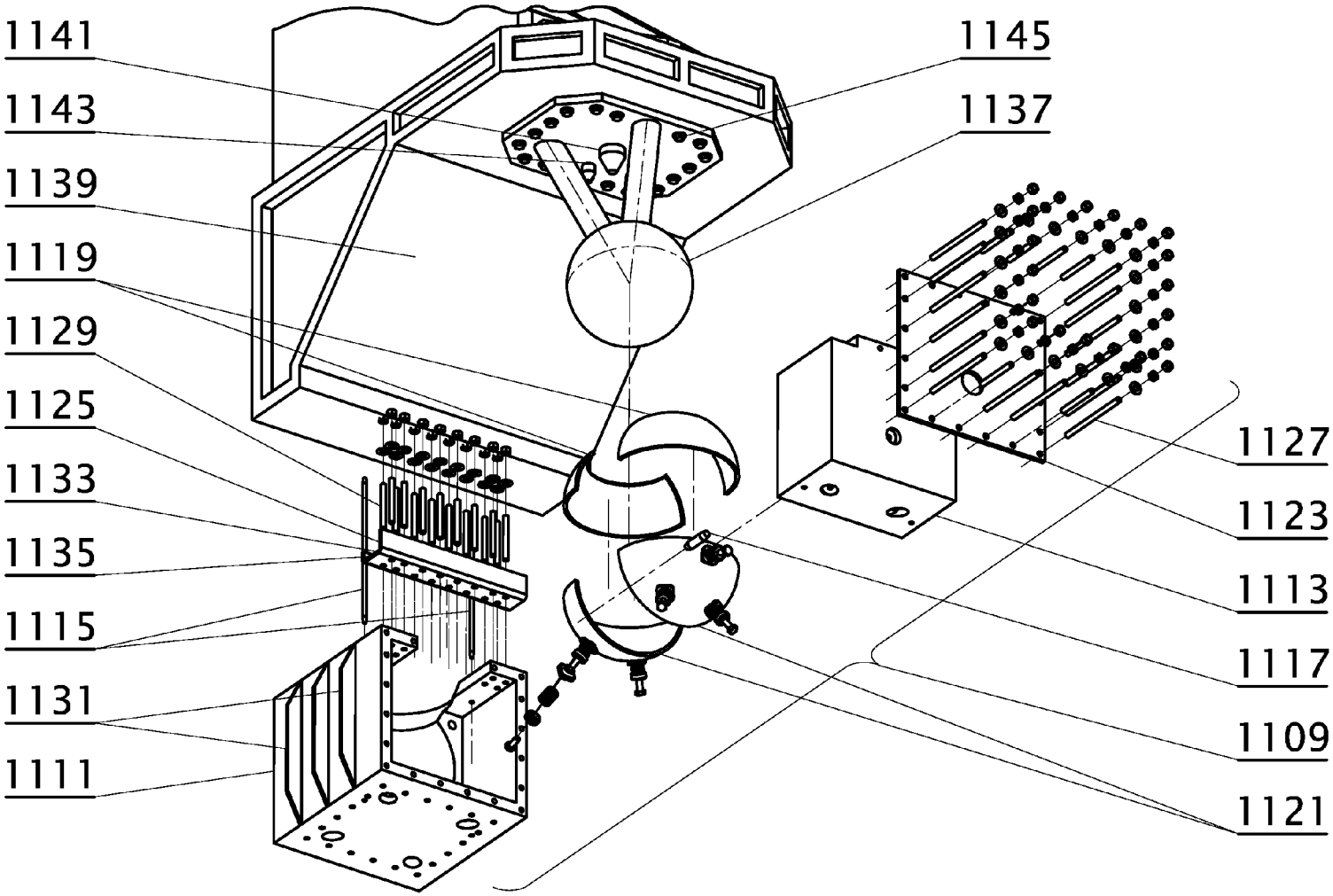

FIG. 11*b* depicts an example of a pivot design utilizing a ball joint.

Figure 11C:
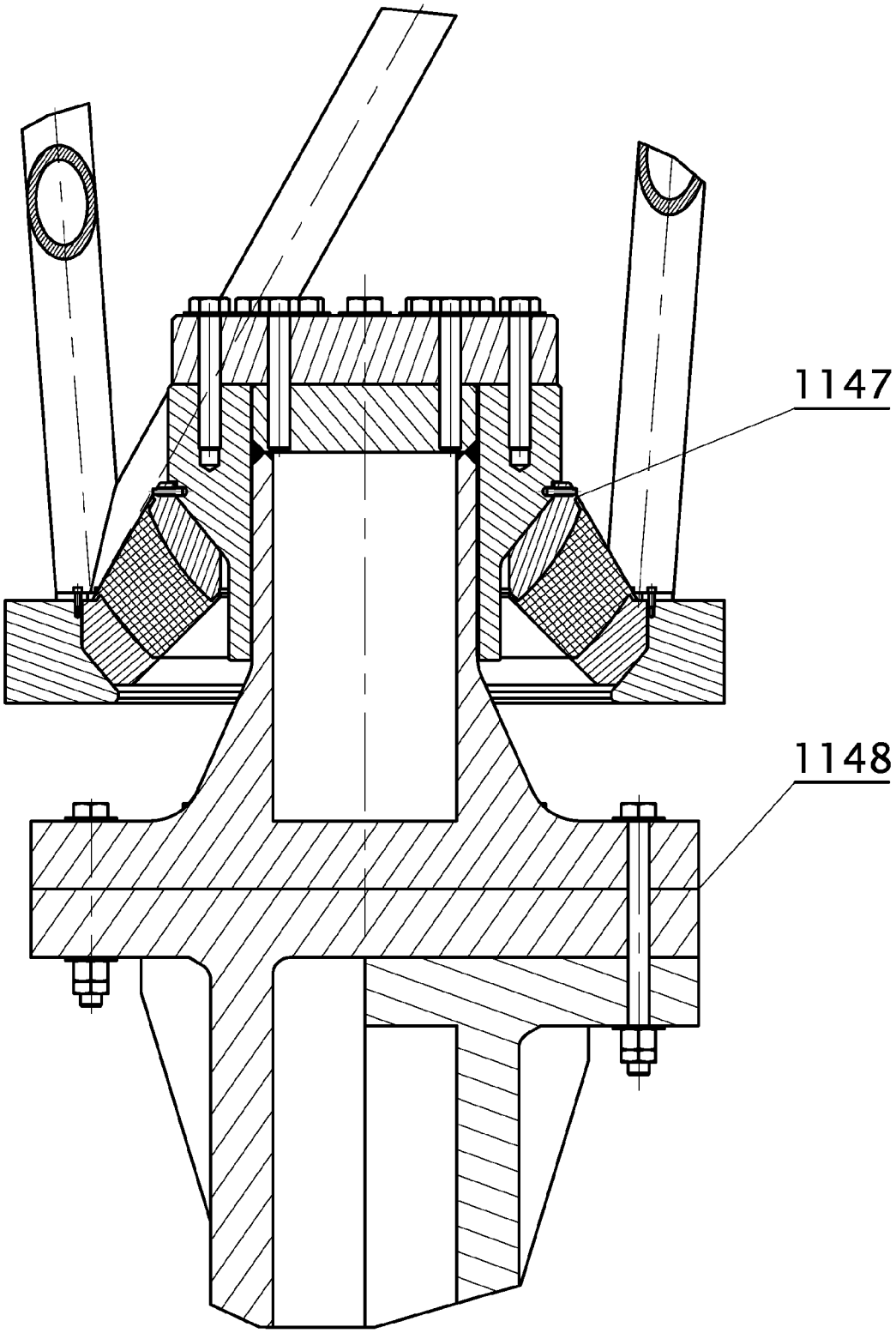

FIG. 11*c* depicts an example of a pivot design utilizing a flexjoint.

Figure 11D:
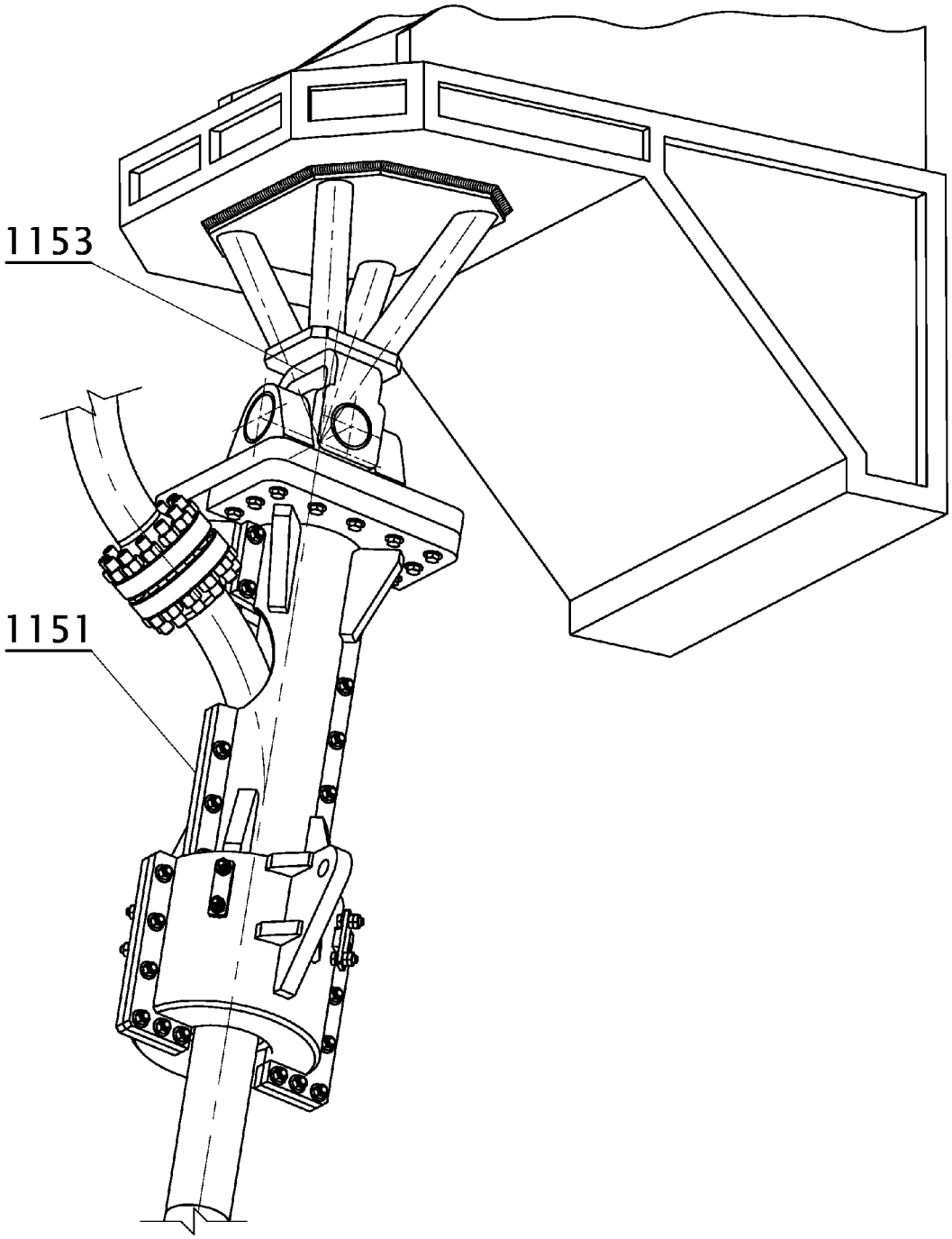

FIG. 11*d* depicts an example of a clamp hang-off design utilizing an universal joint.

Figure 11E:
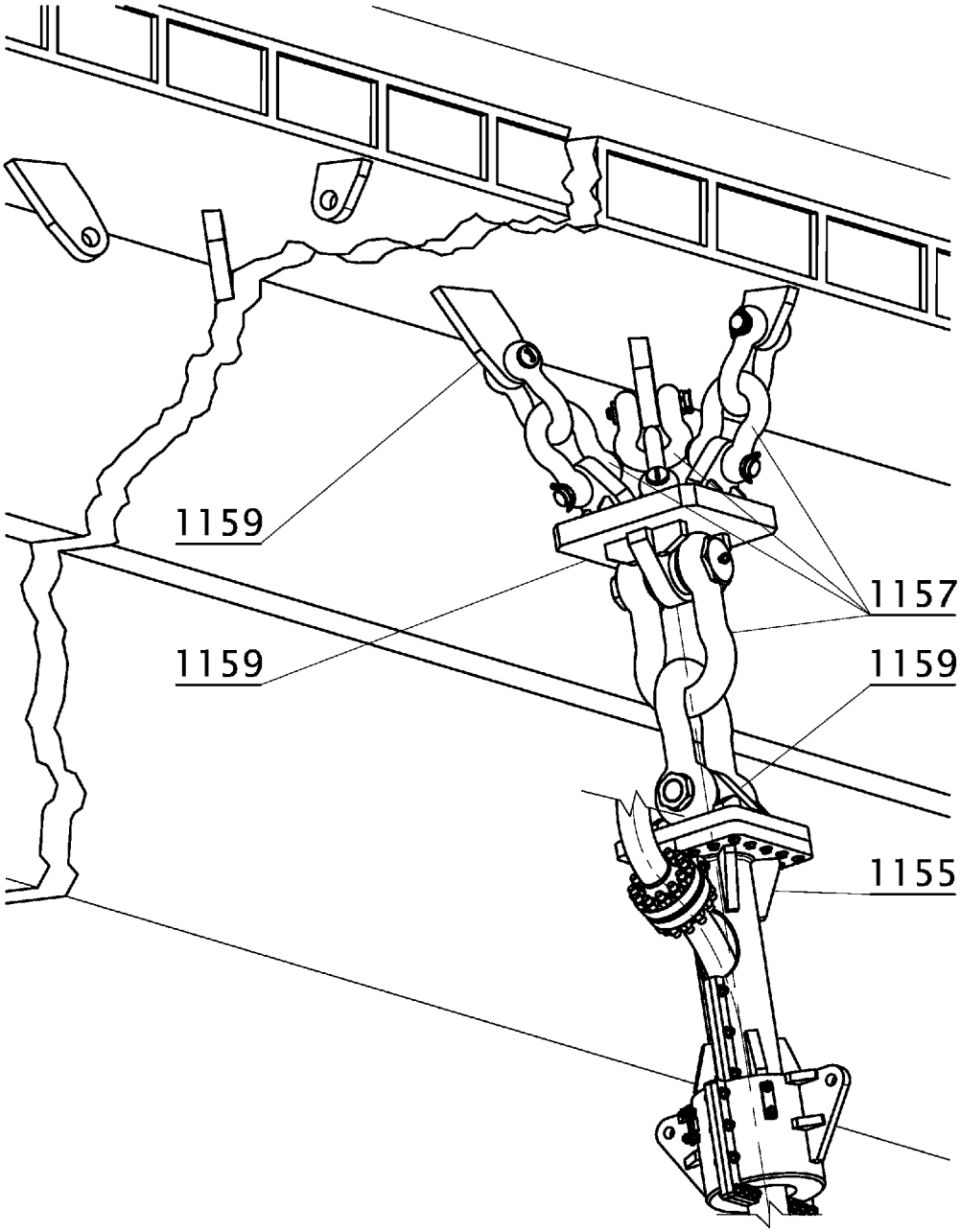

FIG. 11*e* depicts an example of a clamp hang-off design utilizing a shackle and pad-eye assembly.

Figure 11F:
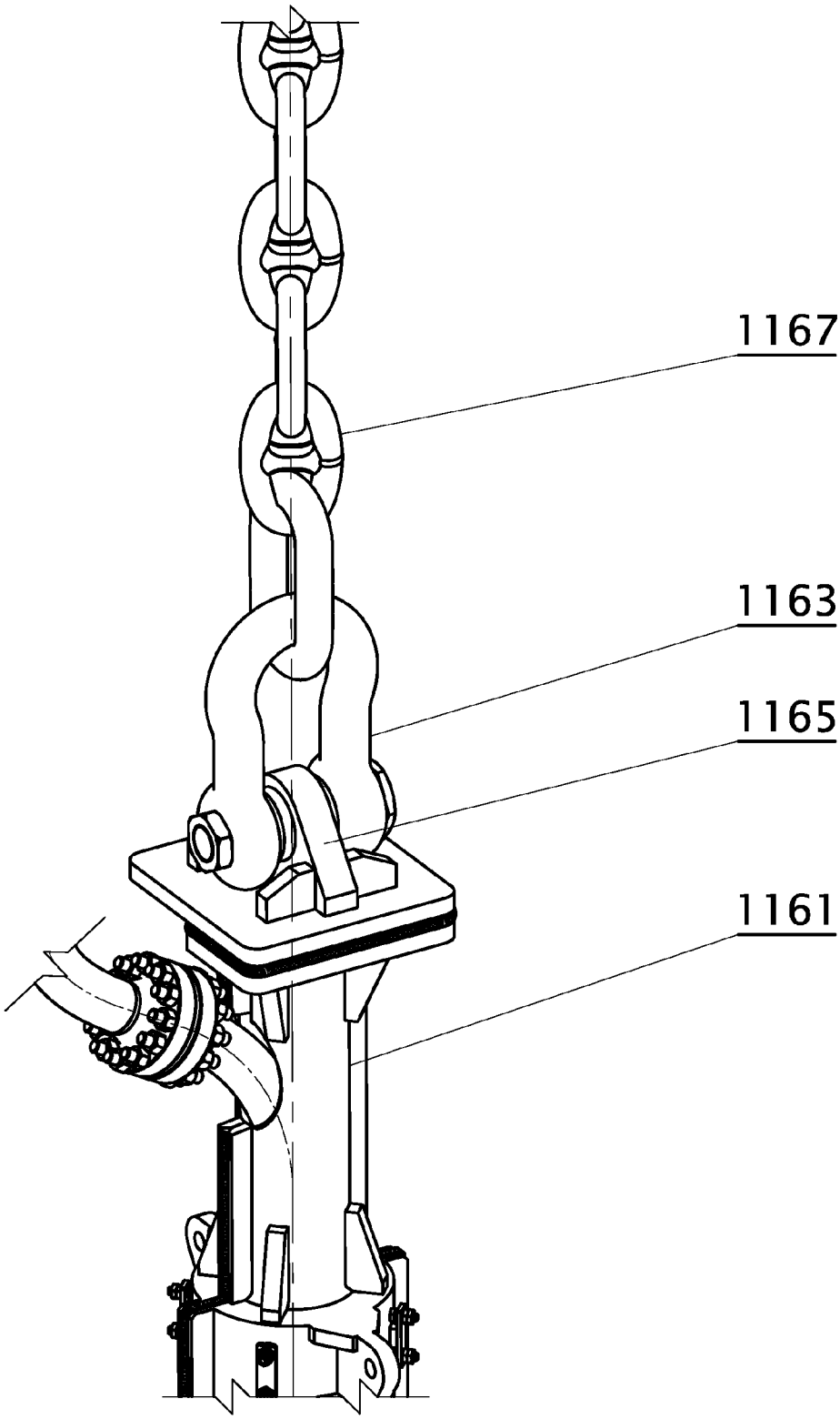

FIG. 11*f* depicts an example of a assembly incorporating a hang-off clamp, shackles, padeye and chain.

Figure 11G:
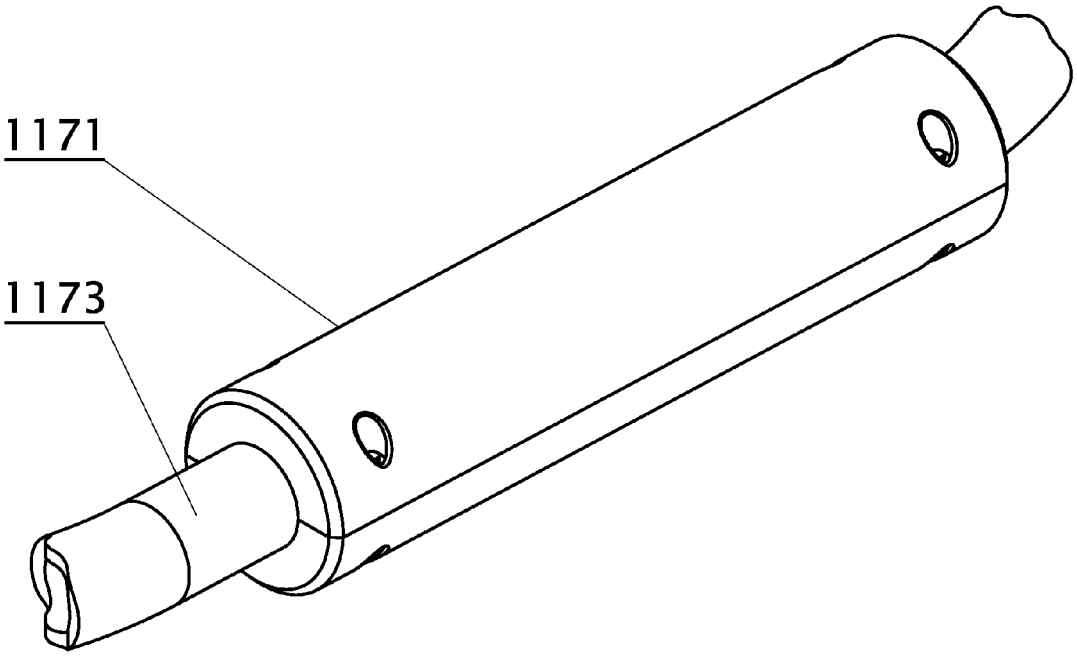

FIG. 11*g* depicts an example of a buoyancy clamp used on a pipe spool.

Figure 11H:
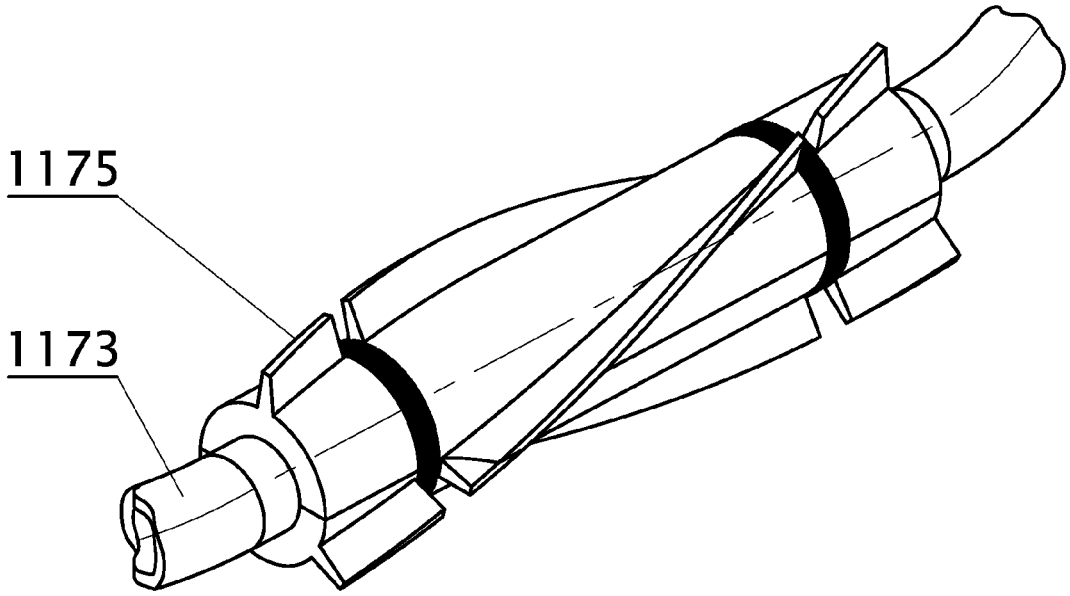

FIG. 11*h* depicts an example of a helicoidal strake clamp used on a pipe spool to suppress Vortex Induced Vibrations (VIVs).

Figure 11I:
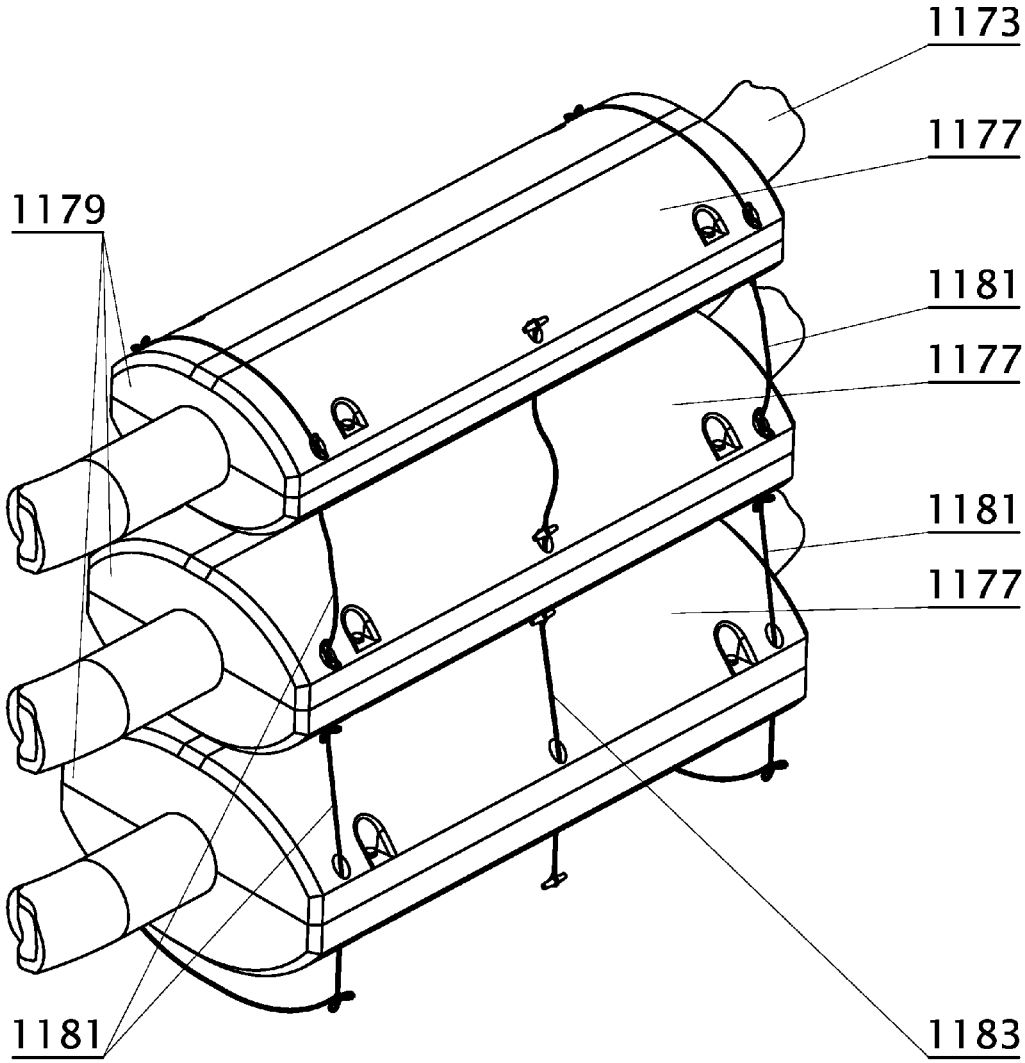

FIG. 11*i* depicts examples of bumper-support clamps which may be used on a pipe spool to suppress VIVs and to support the submerged weight of parts of the spools.

All the pipe elbow bends depicted for sake of examples in FIGS. 2 through 11 are planar 5D bends, including all goosenecks as well as all spiral entry and spiral exit bends. It is, however, noted that those are examples only and that any bend radii can be used in these designs. The radii of curvatures of the curvilinear 3-D spirals depicted herein are all greater than 5D, either slightly greater or considerably greater. It might be also beneficial to use three dimensional bends in some designs. 3-D bends might for example make the spool system more compact, which might result in lowering stresses, make it easier to connect to other spool components by extending the lengths of straight pup-joints between those components, allow easier fitting of flanges or connectors into the system, etc.

DETAILED DESCRIPTION OF THE INVENTION

Figure 1A:
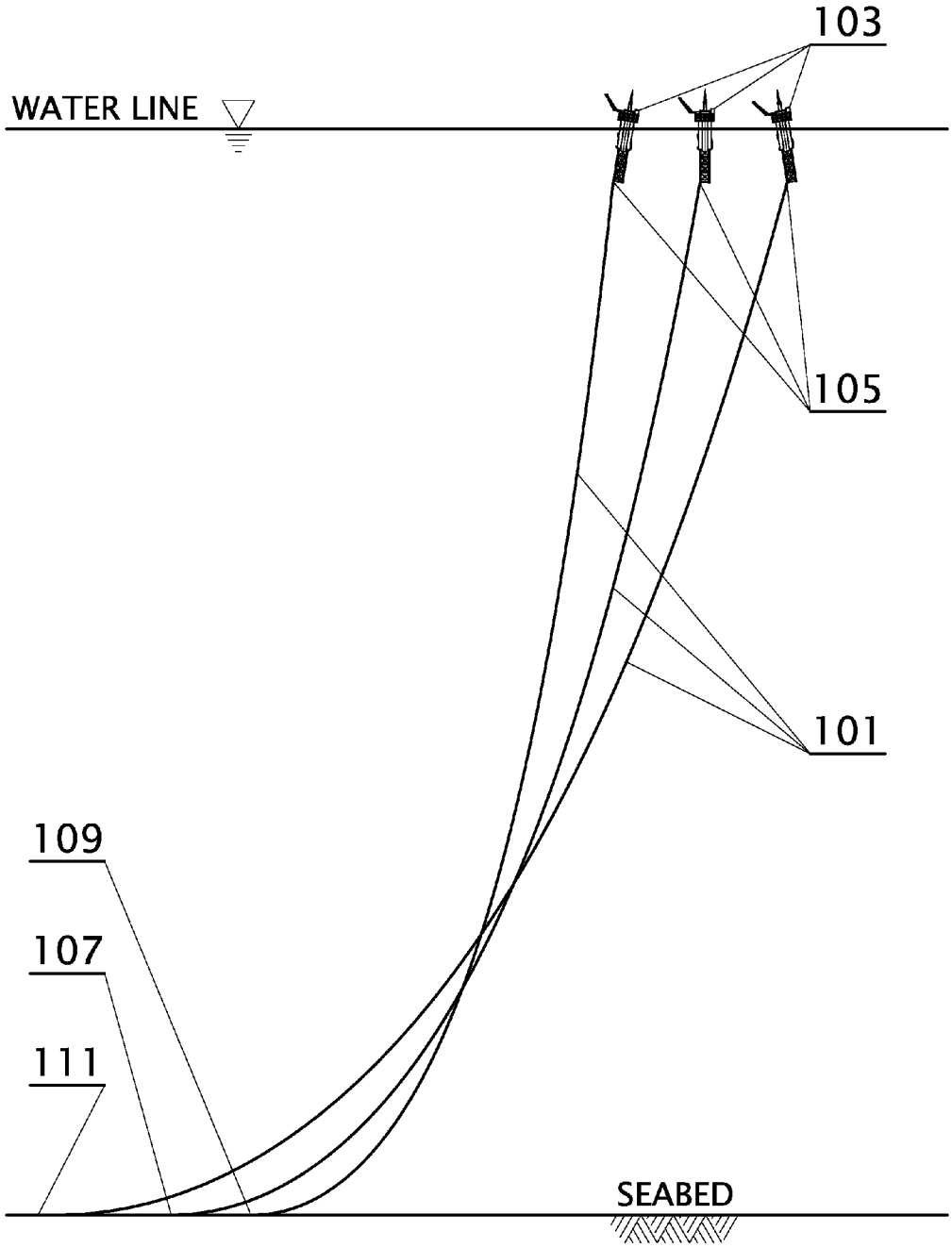
Figure 1B:
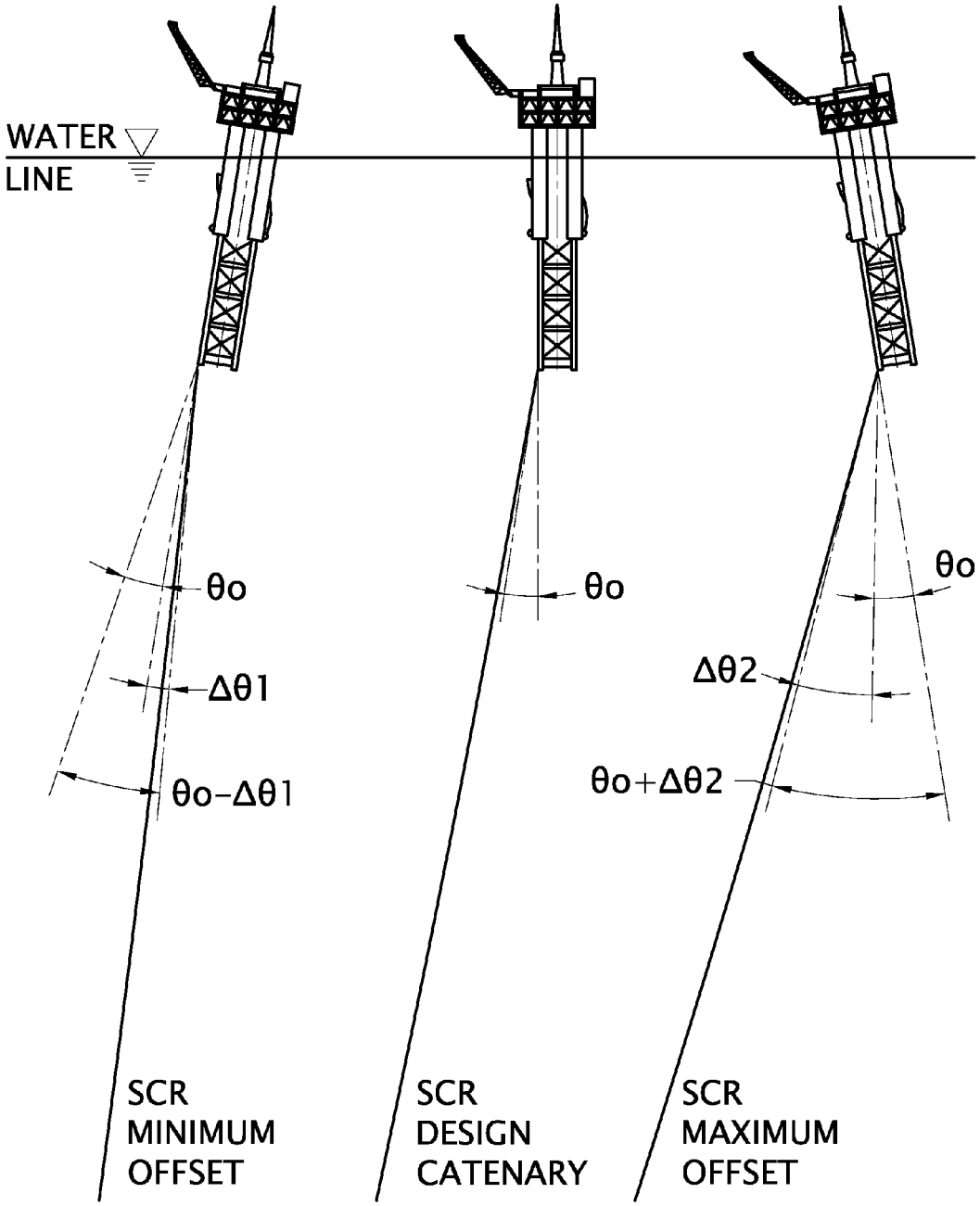

An example of a catenary riser 101 suspended from a truss spar floater platform 103 is shown in FIG. 1*a*. As the spar surges and pitches, at the riser hang-off location 105 the riser 'attempts' to assume in-plane (IP) orientations characterized by dynamic offset angles ranging between in plane angular offsets $\Delta\theta 1$ and $\Delta\theta 2$. The angular offsets $\Delta\theta 1$ and $\Delta\theta 2$ are measured from the tangent to the riser axis at the hang-off of the design catenary of the said riser pertaining to the mean, design location of the platform. The in-plane design hang-off offset angle is angle $\theta o$, see FIG. 1*b*. FIG. 1*b* is a detail view from FIG. 1*a*.

In addition to surging and pitching floaters also sway, roll, heave and yaw and risers deflect that result in additional out-of-plane and also modifications of the in-plane offset angles in addition to those implied by the surge and pitch. The out-of-plane offsets and those additional in-plane offsets would be routine for those skilled in the field and accordingly are not additionally illustrated herein.

Floater surging and pitching can attain large amplitudes, like those shown for example in FIG. 1. Typically the surge and pitch motions (named relative to the 'in-plane' design plane of the catenary) occur with different periods and accordingly, from time to time the maximum angular offsets due to the surge and the maximum angular offsets due to pitch coincide, as it is shown on the example depicted in FIGS. 1*a* and 1*b*. The range of offset angles $\Delta\theta 1$ and $\Delta\theta 2$ typically increases additionally due to additional deflections of the risers that are caused by quasistatic drag forces on the risers and dynamic forces on risers. These quasistatic and dynamic forces result from current and wave (relative current flow) interactions with the system components. The said drag forces can be increased if VIVs are present.

Simultaneously with the variations in the offset angles, the hang-off location on the spar moves both horizontally and vertically in-plane (and also out-of-plane) of the catenary. The riser touch-down point (TDP) moves accordingly from the mean design location 107 towards locations 109 and 111, which are additionally modified by currents. With the motion of the TDP between 109 and 111, the submerged weight of the suspended part of the riser 101 that is supported at the hang-off varies considerably, it is the lowest at the TDP at the near location 109 and it is the greatest with the TDP at location 111.

The quasi-static vertical load of the catenary riser at the hang-off 105 is approximately equal to the said submerged weight of the riser. The quasi-static horizontal tension in the riser varies little along the catenary. This horizontal tension is the greatest when the TDP is located at 111, and it is the smallest for the TPD at 109.

The total effective tension at the hang-off is equal to the vector sum of the said vertical and the said horizontal load components at the hang-off.

The said total effective tension at the hang-off provides a stress stiffening effect to the SCR structure at the hang-off location 105, which affects the angular deflections of the riser below the hang-off, together with the bending stiffness of the riser and the riser stress joint at the hang-off, if present.

In a case wherein no pivot is provided at the hang-off 105, the rotational stiffness at the hang-off is the bending stiffness of the riser (or the SCR stress joint) at the hang-off. In such a case, the pipe cannot rotate at the hang-off and the relative in-plane angle is constant at $\theta o$, independent of the in-plane or out-of-plane offsets of the platform.

In a case where a pivot is provided at 105, the deflection angle $\Delta\theta$ depends on the bending moment and on the effective in-plane rotational stiffness at the pivot. The said effective in-plane stiffness at the pivot is the sum of the in-plane rotational stiffness of the pivot arrangement (non-zero and typically non-linear whenever a flexjoint is used) and the in-plane rotational stiffness of the spool system, reduced to the location of the pivot 105. The said effective in-plane rotational stiffness of the spool system combines the torsional stiffness of the spool system together with the bending and shear stiffnesses of the spool system, all reduced to the pivot location 105. For large deflections the said rotational in-plane spring stiffness is non-linear, but it can be easily determined for any load condition using FEA. Approximate values can be calculated 'by hand' using basic structural engineering approach. Performing the FEA and/or the said approximate hand calculations is known to those skilled in the field.

Words such as "spiral", "helix", "coil", "helicoids", etc. as may be used herein to describe various embodiments of the invention should not be limited to definitions thereof used in other contexts (including, without limitation, mathematical works). Rather, the invention is the claimed method and apparatus described in this disclosure and illustrated in the representative embodiments shown in the drawing figures. The novel configuration of the stress-relieving segment of a riser according to the present invention is not necessarily a single, geometric shape but rather may comprise a plurality of shapes, both 3-D and planar, as demonstrated in the illustrated embodiments.

In particular, any spools of types represented in FIGS. 2 through 10, or any of their parts are regarded herein as coils, spirals or helices. In addition to the above figures that might or might not be depicted herein but which can be strictly or approximately represented in 2-D or in 3-D by straight or curvilinear segments resembling letters 'L', 'C', 'S', 'Z', 'O', etc that include line segments that are approximately orthogonal to the axis of the riser pipe near the hang-off are also regarded herein as spirals and claimed as novel according to this invention.

In particular, pipe spool shapes resembling the said letter 'L' are regarded herein as partial, approximately half-loop spiral shapes, pipe spool shapes resembling letter 'C' are regarded herein as partial, approximately three-quarter spiral shapes, etc. whether or not the sides of the said partial spiral shapes are curvilinear or straight, whether or not the corners of the said spiral shapes are sharp, or smoothened utilizing constant or variable radius bends.

In cases when the base riser pipe and the tubing used for the construction of a spool system, like for example those depicted in FIGS. 2 through 10, the effective combined rotational stiffness of the system reduced to the hang-off pivot location 105 is low in comparison with the bending stiffness at the stress joint or of the riser pipe at 105, whichever applies, if treated as a rotational spring stiffness. Accordingly, the SCR pipe (stress joint) is almost free to rotate at the pivot, which means that:

- The angular offset (rotation angle) of the spool pipe where attached to the riser (goosenecks 241 and 243 in FIG. 2 or at the pivot, if there is no gooseneck) is almost the same as that of the riser at the pivot.
- There is only limited bending in the riser stress joint, in the SCR tapered (or stepped) transition joint and/or the SCR pipe below the pivot—most of the angular offset $\Delta\theta$ is transferred to the spool system 205.

The spool systems 205 and 207 are relatively flexible in rotation reduced to the pivot location when compared to the bending stiffness of the SCR/stress joint/transition joint at the riser hang-off 105.

Accordingly, most of the bending required is in the designs according to this invention 'absorbed' structurally by combined torsion, bending and shear deformations in the flexible spool system 205 and/or 207. Because, for the same length, a cylindrical pipe is relatively more flexible in torsion that it is in bending, it is preferable to enhance structurally the torsional flexibility of the spool system. This is carried out by optimizing the geometrical configuration of the spools. The said optimization is best effected by locating the pivot close to the torsional center of the spool spiral, see for example FIG. 2.

The said combined rotational flexibility of the spool system reduced to the pivot location can be increased by means of:

a.—Increasing the lengths of those spool segments that are orthogonal to the in-plane riser bending plane; this can be carried out by increasing the diameter of the spiral and/or increasing the number of the turns in the spiral.

b.—Spirals or helices based on polygonal shapes and other non-circular shapes work better than circular spirals or helices. This is because the said polygonal shapes utilize greater pipe lengths per spiral turn than circular spirals do. By polygonal shapes for example quadrangular, triangular, pentagonal, hexagonal, and other polygonal, elliptical, oval, 'L'-shaped, etc. shapes are meant, including spiral or helicoidal shapes. The torsional shape effectiveness improves even more with increasing transverse dimensions of the shapes used (say diameters of the said entities) and with decreasing radii of the bends used, (say XD, etc., 10D, etc. 5D, etc., 3D, etc., 0D; X being an arbitrary, real non-negative number).

c.—Minimizing the bending and non-torsion shear stiffness 'pollution', by locating the pivot close to the optimum (central) location of the said spiral, helix, etc.

d.—Keeping the average pitch of the said spiral, helix, etc. low, for better said orthogonality.

e.—Planar spirals or helices arranged in planes perpendicular to the axis of the SCR at the pivot location are more effective in converting bending of the riser pipe to torsional loads in the spools than progressive spirals are. This is because the said planar spirals are exactly orthogonal to the riser axis at 105. On the other hand, for progressive spirals, the said angle oscillates along the spiral around the said orthogonal direction.

FIGS. 2 through 10 depict examples of structurally effective spool designs according to this invention. The design configurations depicted in the figures are examples only that illustrate the principle of this invention. Many other configurations according to this principle are feasible and there are understood to be included in the subject matter of this invention. In addition to that, it is also understood that most design details and variations depicted in FIGS. 1 through 11, those features and design alternatives described herein as well as all other design variations and solutions, whether general or specific to any applications are also covered by the subject matter of this invention.

All the designs depicted on the said figures feature various implementations of spiral shapes, because spirals provide geometrically compact ways of arranging approximately orthogonal pipe lengths in the vicinity of the said pivot locations. However, it is noted that the spools according to this invention do not need to be arranged in approximately full loop spiral shapes in order to be structurally effective. For example, partial loop shapes like for example L-shapes and C-shapes and other segmented line shapes and their combinations, including combinations that reverse the looping directions (the letters 'S' and 'Z' shapes being just some examples of such reversals) can be also structurally effective in providing the said torsional flexibility to spool systems according to this invention.

The said segmented lines can feature any combinations of curvilinear and/or straight segments and the statements about spool effectiveness listed a few paragraphs above apply to all spiral spool arrangements, in the broadest possible sense highlighted herein. In cases when the said segmented lines feature polygons, these can be either regular or arbitrary irregular polygons, including regular and irregular polygonal spiral shapes.

It is also noted that piping adjacent to the spiral spools also participates in making the combined spool system more flexible, while introducing some level of axial asymmetry in the structural flexibility of the combined system. The said level of axial asymmetry can be controlled by orienting the spiral entry and the spiral exit spool joints at different azimuth angles (i.e. angles measured in the planes orthogonal to the riser axis at the pivot point) and at different meridional angles (i.e. angles between the riser axis at the pivot and the axis of the spool). The said level of axial symmetry can be also controlled by using higher or lower numbers of turns or loops in the spirals and by using spirals featuring the said azimuth angle variations along the entire spiral length that are closer or farther from integer multiples of 360°. The combined detailed effects of the said spool geometry on the 3-D flexibilities of the system can be assessed using FEA or by performing approximate structural calculations that are well-known by those skilled in the field.

It is also noted that other non-polygonal and non-broken line shapes of spirals are also covered by this invention, even though they might have not been explicitly mentioned or shown on any of the figures. These include for example approximately spherical, approximately parabolic, approximately elliptic, and conical spirals, etc. and other more complex two and three dimensional shapes. In particular conical spirals can be regarded as a not shown generalizations of circular spirals in a similar way pyramidal spirals shown in FIGS. 7*b* and 7*c* are generalizations of polygonal spirals depicted on many figures.

Figure 2A:
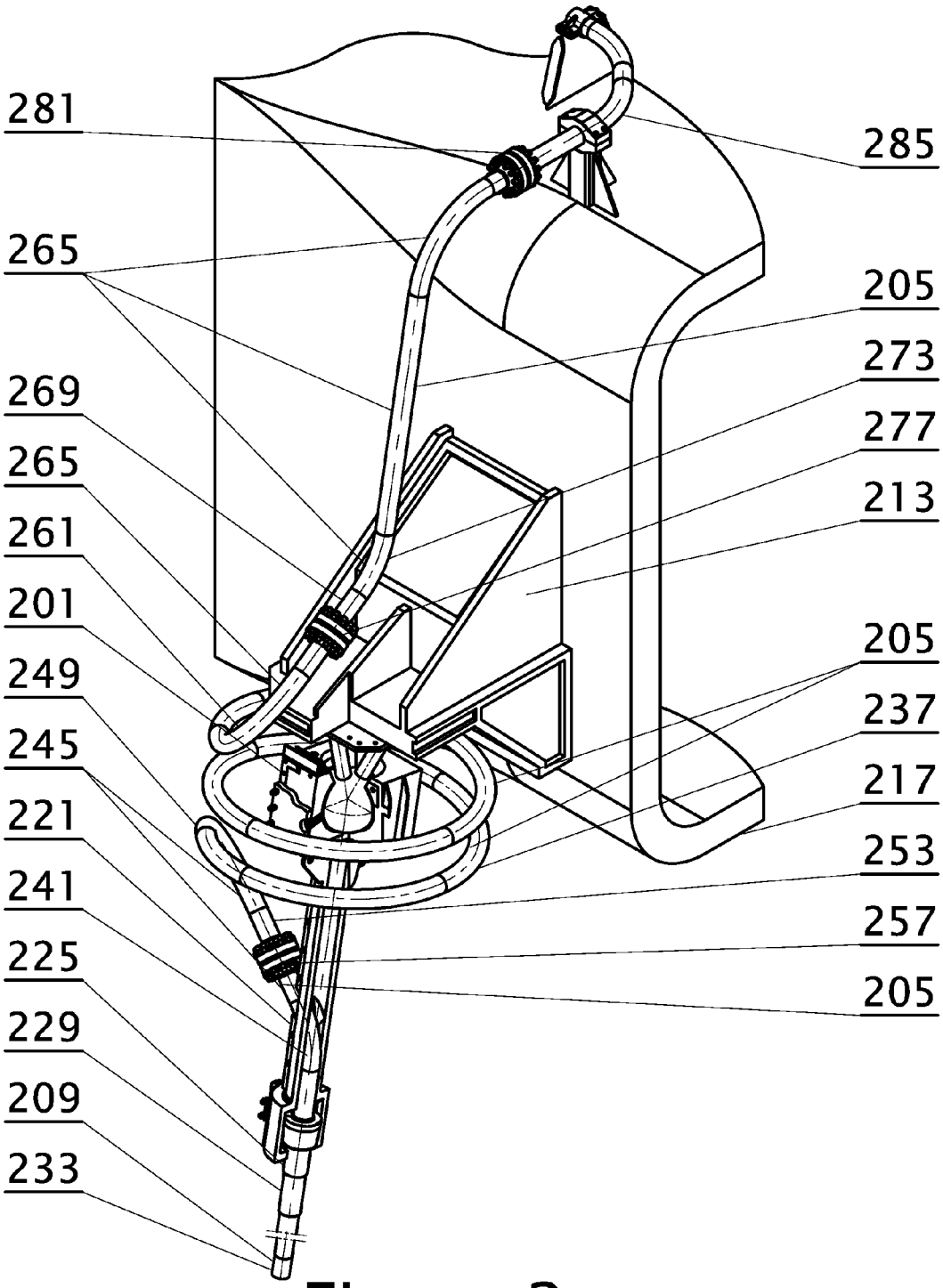
FIG. 2*a* features a circular spiral spool and FIG. 2*b* features a quadrangular spiral spool.
Figure 2B:
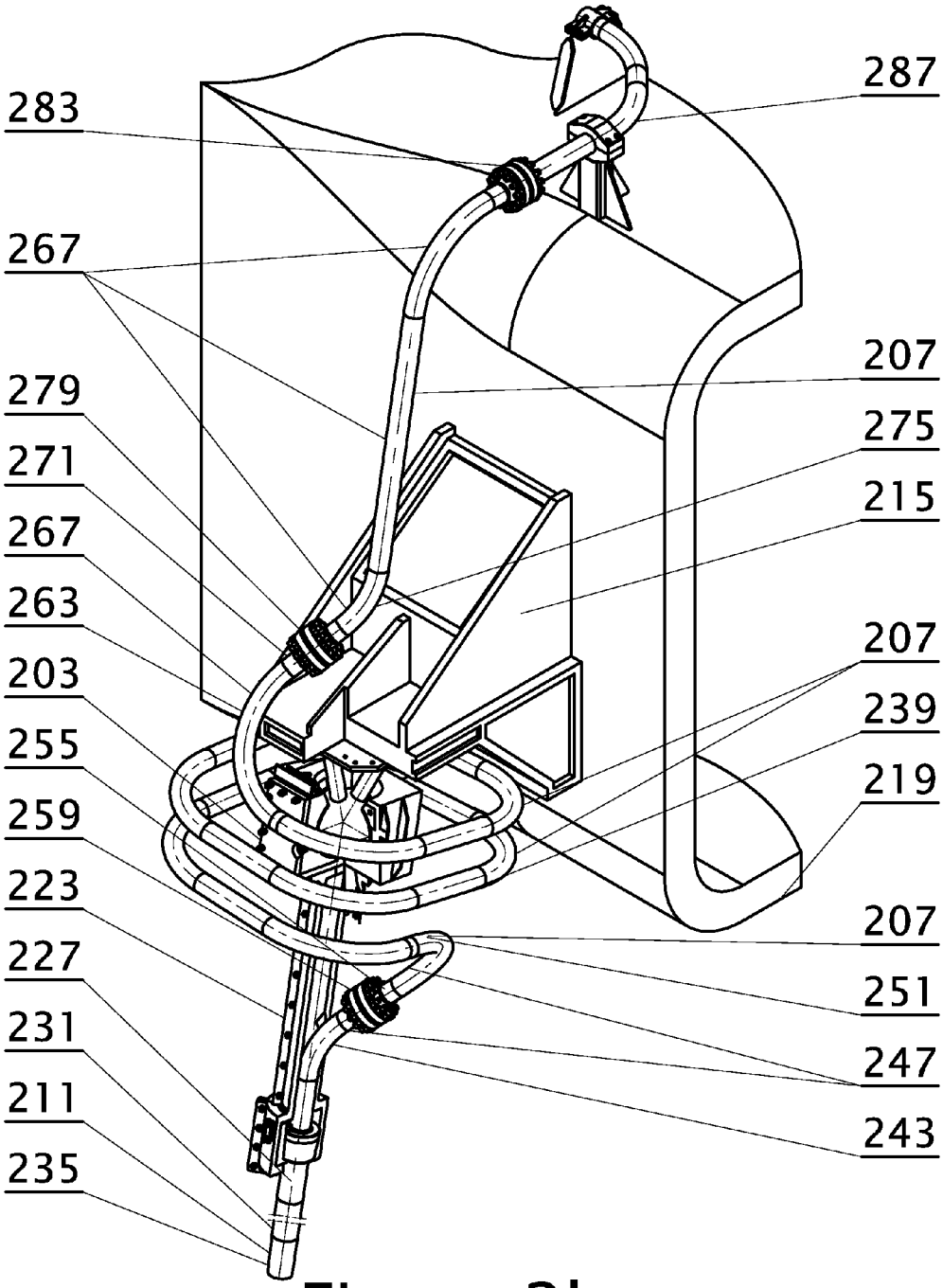
FIG. 2 depicts pivot-spool arrangements featuring ball joints located close to the centers of progressive spirals.

FIG. 2 depicts pivot spool arrangements featuring ball joint assemblies 201 and 203 located close to the centers of progressive spirals. FIG. 2*a* features a circular spiral spool 205 and FIG. 2*b* features a quadrangular spiral spool 207.

The axial loads on the risers 209 and 211 are transferred to riser porches 213 and 215 that are attached to sides of pontoons 217 and 219. Porches 213 and 215 can be attached to any kind of platform known, however, those featured in FIGS. 2*a* and 2*b* might be used for example on semi submersible vessels, or on TLPs, or on FPSOs. It is clear to those skilled in the field that instead of porches 213 and 215, continuous or non-continuous riser banks that support more than one riser each could be used, other support structures like for example turret structures of an FPSO, etc., can be used instead of porches shown in FIGS. 2*a* and 2*b* without any loss of generality of this invention.

The tension in the said risers is transferred to hang-off clamp assemblies 221 and 223 that are attached to ball joints 201 and 203. Ball joints 201 and 203 transfer the effective tension in the risers to the platforms through porches 213 and 215. It is noted that FIGS. 2*a* and 2*b* depict optional bolt connections between hang-off clamp assemblies 221, 223 and ball joints 201, 203, respectively. This type of connection depicted is an optional solution that is structurally feasible, however, in the particular designs depicted in FIGS. 2*a* and 2*b*, as well as on many other figures herein use of full penetration butt, etc. welds between parts like hang-off clamp assemblies 221, 223 and ball joints 201, 203 are preferred for structural reasons.

The above is also relevant to joints between other implementations of pivots, like for example flexjoints, universal joints, etc. and hang-off clamps, see for example FIG. 10*b* that demonstrates a use of an implementation of this invention utilizing receptacle basket 1019.

The preferred implementations of this invention involve the use of the said receptacle basket 1019 with example designs like those shown for example in FIGS. 2*a* through 3*b*, FIGS. 7*a* through 8 and FIG. 10. In most of these designs, and in many other designs not shown, the said receptacle baskets can be preferably incorporated structurally inside riser porches, riser banks, etc. which is a commonly used design solution known to those skilled in the field. For design implementations similar to those depicted for example in FIGS. 4*a* through 6*b*, the preferred use of the said receptacles would involve fitting the receptacle in a bellmouth, in an exit of a hawse pipe, in an exit of an I-tube, in an exit of J-tube, etc., which again is a common practice known to those skilled in the field. In these cases it is a common practice to permanently clamp the said receptacle baskets to the said exits of the I-tube, J-tube, hawse pipe, bellmouth, etc. utilizing bolts or other means like latching, etc.

In the preferred designs involving the use of the said receptacle baskets, similar to 1019 shown in FIG. 10*b*, all the joints between parts and components like those depicted for example on FIGS. 2 through 11, would preferably be welded above the water surface either onshore or offshore, just before the subsea installation. Accordingly, the system installation operations would be in these cases similar to the installations of conventional riser systems in that the 'principal' structural subsea connection would involve either:

- landing the top, fixed end component of a pivoting arrangement in the receptacle basket, or
- pulling-in and clamping, latching, etc. to a bellmouth, an I-tube, a J-tube, a hawse pipe, etc. the receptacle basket attached to the top, fixed end component of a pivoting arrangement above the surface.

Both the above described classes of design solutions and offshore installation operations pertaining to these solutions are common and well-known to those skilled in the field. A small modification to an offshore installation of a conventional riser system would involve the spiral system in the installation procedure. The said spiral system can be installed subsea:

- preferably, while attached to the said riser system utilizing a spiral support frame, or similar, if required;
- optionally, separately from the riser system either before or after the riser system is installed.

It is noted, that with many implementations of this invention it might be possible to incorporate the pivoting arrangement inside the receptacle basket. Such solution is a common practice and it is shown for example by Langner in U.S. Pat. No. 5,269,629 that demonstrates such an arrangement with a conventional riser flexjoint. Flexjoint like those depicted for example in FIG. 11*c* and elsewhere herein, can also be arranged inside receptacle baskets. Other pivoting arrangements like ball joints, etc. can be also arranged inside receptacle baskets similar to 1019. With regard to specific solutions involving the use of ball joints, it is noted that either:

- a meridionally-split external parts of the ball joint similar to those shown in FIGS. 2, 10*b* and 11*a* and 11*b* could have their external shape modified to fit the receptacle basket; the operations of such ball joints would thus be reversed in that the joint would be effectively flipped 180° and the said joint ball would be welded, or otherwise connected structurally, to the said riser hang-off clamps utilizing a tapered stress joint, etc.;
- in such cases it would be preferable to use instead more common arrangements of ball joints featuring the external parts of the said ball joints split near to the joint 'equatorial' plane; such arrangements may be readily deduced by those skilled in the field on the basis of the description above.

However, it is understood that in the preferred implementations of this invention the pivots should be located near to the centers of the spirals and in many cases there might not be enough room inside a spiral for the pivoting arrangement assembly, for the receptacle basket and for the structural support of the receptacle basket. In such cases, the receptacles may be located above the pivoting arrangements as it is shown for example in FIG. 10*b*.

Optionally, when the fixed part of the pivoting arrangement is welded to the riser porch, riser bank, etc., connectors can be used as principal subsea joints made during the offshore installation of the system between the pivoting arrangement 201, 203 and riser hang-off clamp 221, 223, see for example FIGS. 7*a* through 7*c* and FIG. 10*a*. The use of the said optional subsea connectors includes in particular utilization of collet connectors. The use of subsea connectors in the said applications is routine for those skilled in the field and with such a use all the parts between the connector and the platform would preferably be welded, etc. together before the offshore installation of the platform used, including vessels and semi submersibles. It is also noted that many off-the-shelf connectors available would be appropriate for the said application. It is also noted, that any of the said off-the-shelf connectors are designed to contain pressure as well as to carry high structural loads. For the said applications according to this invention it is often not necessary for a connector utilized to contain pressure, see for example FIGS. 2*a* and 2*b*, FIGS. 3*a* and 3*b*, FIG. 7, etc. Accordingly, in addition to utilizing an 'off-the-shelf' connector, the design of such a connector could be customized for the application according to this invention, which might in particular cases involve design simplifications. It is also noted that it is also feasible to design a custom-made connector for the said applications according to this invention. Many design variations are feasible for the application of connectors according to this invention, which will be readily deduced by those skilled in the field.

Bolted connections like those shown for example in FIG. 2*a* through FIG. 3*b* can also be utilized as optional design solutions.

The top segments of risers 209 and 211 would be usually (but optionally) strengthened with optional stress joints 225 and/or 227 and/or with optional transition joints 229 and/or 231. Typically, transition joints like 229 and/or 231 shown incorporate several steps (stepped transition joints, example 209) with gradually increasing wall stiffnesses, between those of the SCR pipes used 233 and 235 and those of optional stress joints 225 and/or 227. Alternatively, transition joints can feature continuously increasing wall thickness, like those called tapered transition joints, see 211, whereas the wall pipe wall thickness used features continuously increasing wall thicknesses between those of the SCR pipes 233 and 235 used and those of the said optional stress joints 225 and/or 227. Design details of the said optional stress joint and of the said optional transition joints can be selected in ways that are known to those skilled in the field. The said selections of the design parameters of the optional stress and transition joints need, however, to be selected in ways that are compatible with the design of the novel spirals 237 and 239 according to this invention.

Generally, the stiffer (smaller and/or less effective) the spirals 237 and 239, the more need there is to use the optional stress joints 225 and/or 227 and/or the more reasons there is to use transition joints 229 and/or 231. Once the decisions of using stress joints 225 and/or 227 and/or transition joints 229 and/or 231 are made, the stiffer (smaller and/or less effective) are the spirals 237 and 239, the greater wall thicknesses of the said stress joints and the greater the lengths of the said SCR transition joints need to be, and vice versa.

Fluids (including homogenous or/and non-homogenous gases and liquids that may carry other phases with their flow) transported inside the SCRs are transferred between the risers and spiral spools 237 and 239 using goosenecks 241 and 243. The goosenecks can feature the same pipe wall thickness as that used to construct spiral spools 237 and 239, or it can be greater in order to decrease bending stresses in the goosenecks. The specific design choices will depend on detailed stress and fatigue analyses of the entire riser-spool systems that are performed in usual ways well-known to those skilled in the field.

Spiral entry spool segments 245 and 247 connect the goosenecks with the spirals. Spiral entry spool segments 245 and 247 typically incorporate spiral entry bends 249 and 251 and straight or curvilinear pup joints 253 and 255. They can also incorporate optionally flanges or connectors 257 and 259.

Spiral exit spool segments 265 and 267 connect the spirals with the platform piping using optional flanges or optional connectors 281 and 283. Spiral exit spool segments 261 and 263 typically incorporate spiral exit bends 265 and 267, straight or curvilinear pup joints 269 and 271 and they can also incorporate additional, optional bends and segments like for example 273 and 275. They can also incorporate optionally flanges or connectors 277 and 279. Spiral exit spool systems are connected to the platform piping 285 and 287. Typically, some optional bending flexibility may be required in the design of the spiral exit spool systems depending on the requirements of any particular structural system. This optional bending flexibility has been achieved in the designs shown in FIG. 2 by using those parts of spiral exit spools annotated 265, 267 featuring greater tubing lengths than those used for the spiral entry spool systems. It is noted that many aspects and details of design implementations depicted in FIGS. 2 through 11 are shown considerably simplified for the sake of illustration. In particular most connections shown as bolted could be optionally bolted, bolted and welded, bolted and welded and additionally reinforced by means of component shape interaction, in particular for those connections that transfer axial forces in the riser hang-off system. The preference would be for bolted connections not to carry axial loads in the system, unless the highest loads are transferred by a combination of shape and full penetration welded connections. It is also noted, however, that the optional use of bolted connections that carry axial loads is also acceptable in designs according to this invention. A close parallel in the known art would be a use of highly loaded bolted flanges that are common in offshore riser and pipeline systems.

Typically, but not necessarily in all cases, the design connections featured herein would be made up for the life of the equipment in question, which means that most connections would typically be designed for a single assembly before or during the installation. Disassembly of any system components at the end of their design life or in cases of unexpected failures could be carried out using other means, including flame or mechanical cutting, cutting using explosive charges, etc. Those components that might have failed structurally, etc. or might require preventive repairs, etc. might be replaced with new components of the same or modified design or repaired, whatever is preferred.

Shackles, bolts, connectors etc. could be diver-less [for example utilizing Remote Operated Vehicle (ROV) and/or other actuations from the surface] or/and made up with a help of divers, as required. Typical subsea equipment (like for example hydraulically and/or mechanically and/or electromagnetically assisted bolt tensioning systems, etc.) could be used, if preferred so. It is understood that the only some example design implementations of connections are shown, and/or highlighted herein, and many other implementations that may differ from those featured are also covered by the substance matter of this invention.

For simplicity, anodes etc. and other similar details are not shown in FIGS. 1 through 11. VIV suppression devices like strakes, etc. and/or wave and current shielding devices and/or buoyancy devices, etc. are also omitted from most drawings for simplicity, it is understood that they will be used by the designer whenever and wherever so preferred, with any of the design implementations of to this invention.

The wall stiffnesses of spiral spools 237 and 239, spiral entry spools 245 and 247 as well as those of the said spiral exit spool systems are selected using usual design approach and preferably confirmed by utilizing FEA. In order to confirm the design using FEA large displacement, non-linear FEAs are required that adequately account for the elbow flexibilities of all the curved elements, including any 2-D elbows (bends) and 3-D curvatures of spirals like 237, in addition to accounting for stress-stiffening in the riser.

Depending on the degree of sophistication of the software used, it may or may not be acceptable to use one-dimensional pipe and elbow elements in the FEAs. In cases the said one-dimensional elements are used, typically in-plane and out-of-plane elbow flexibilities used would require calibrations using shell and/or solid elements, as required by the details of the specific system modeled. These include any possible effects of bent torsion on the said flexibilities. Additional calibration-validation of the modeling techniques needs to account for any 3-D curvatures of the piping used, like that of spiral spool 237. For spool 237 accounting only for in plane and out of plane elbow flexibility might be insufficient.

The design of the SCR/spool piping systems according to this invention needs also to take into account in particular:

- The ease of installation considerations including assuring structural integrities of all components used at all stages of installation and in service,
- The reliability of all the components used, need for access and inspections,
- The servicing requirements,
- Passive and active corrosion protection, including the use off corrosion resistant alloys and other materials, in particular nearly homogenous materials like for example, ferritic and/or austenitic alloys, including Duplex alloys, including Super-Duplex alloys, including Inconel alloys, etc.
- Thermal insulation (or even heating, if applicable) requirements,
- Bearing loads and materials used, like bushing, roller bearings and their types, Lubrication requirements for interacting components, like those of the ball joints 201 and 203—these might require a use of for example bronze, teflon, nylon, etc. materials on the ball joint or universal joint contact surfaces, VIV analyses and suppression or/and prevention, if required, Stability of the cross-section shapes deformed under the loads applied, Effects of the deformations of the tubing on structural flexibilities of system components, including elbow flexibilities, The buoyancy of the pipe per unit length required in order to limit spool system deformations (if necessary) due to the submerged weight; this is in particular important when very heavy wall pipe is used (high internal pressures), Need of sheltering the spool systems from hydrodynamic loads by arranging them inside fully or partly enclosed space utilizing shields that protect system components from hydrodynamic forces in currents and wavers, decreasing drag loads by using fairings, etc., if applicable.

Structural design factors and/or load and resistance factors.

Stress concentration factors.

Kind and formulation of elements, etc. used in structural and hydrodynamic modeling, etc.

The above list is typical for any offshore piping/structural system and it might not be complete for particular systems to be designed. The specific kinds of requirements are system and design specific and are in each specific and particular case known to those skilled in the field.

It is noted, however, that the said spiral spools and their entry and exit spool systems can be subjected to significant torsional deformations. Torsional deformations might not be well accounted for in many pipeline, riser and piping and structural codes used in offshore engineering.

In particular, many design codes do not include allowances for torsional straining of the material while computing allowable combined stresses or allowable equivalent Huber-von Mises-Hencky stresses (HMH). Many widely used engineering codes use simplified, application specific design formulae that might or might not account for torsional stressing or for pipe cross section stability under complex loading including torsion. Adequate, formulations corresponding might be also unavailable from the FEA for some simple line elements (types: pipe, beam, elbow and similar).

Accordingly, with regard to these designs, it is recommended to perform additional stress checks. It is in particular recommended to:

Use all stress components, adequate element formulations and adequate, theoretical values of equivalent HMH stress computations provided by FEAs or by detailed stress analyses from 'first principles', in addition to those formulated in design codes, Use design codes that properly account for all stresses and strain components in the material, like for example the ASME Boiler and Pressure Vessel Code, Section VIII (Division 1 or/and 2), that use for example the stress intensity in the design. Stress intensity formulation used should account properly for all the stress components, including structural, steady state thermal and transient thermal stresses, wherever and whenever applicable.

Select higher design factors than used commonly for piping systems that are not subjected to torsional shear straining, if necessary.

It is noted that the above modeling, analyses and design considerations are well-known to those experts skilled in the field. Expert level help needs to be sought, whenever in doubt about any of the items highlighted herein.

The selection of pipe material is important. Depending on the maximum structural and fatigue loads and sizing of the spiral spools high yield strength offshore pipe materials or higher strength steels, like for example AISI 4130 can be used. Generally, the use of higher strength materials allows the engineer to achieve more compact designs. Where higher loads occur, higher strength alloys, like titanium alloys can be used. Alternatively, more flexible materials including other metallic materials and non-metallic materials, including FRPs can be used.

The materials used can feature very wide ranges of mechanical properties. The most important properties are the bulk shear modulus (and the elastic modulus) together with the bulk yield, ultimate and fatigue strength of homogenic, approximately homogenic (steels, alloys, etc. are regarded as homogenic or approximately homogenic for the purpose of this specification) or composite material used. The following combinations of beneficial properties can be used:

High strength materials (examples include most steels, whereas the shear and elastic moduli are typically high in addition to high strength properties)

Low shear and elastic moduli and not very high strength materials (examples include some metal alloys, most thermoplastics and many FRPs)

Low shear moduli and high strength materials (examples include titanium alloys, some FRPs, like some FRPs utilizing for example carbon fibers, nanotubes, KEVLAR® aramid fibers, etc.).

The latter group of the said materials featuring low shear moduli combined with high strength properties provides the most beneficial structurally set of mechanical properties for construction of the said spiral spools. When FRPs are used, beneficial low effective (bulk) shear moduli can be achieved by suitable spatial arrangements of reinforcing fibers in the material. The shear moduli of the fiber material itself may or may not be high. Using suitably engineered FRPs or other pipe cross-section of complex design can allow achieving low bulk torsional stiffness, combined with high hoop stiffness and high axial stiffness in tension, which the combination is particularly beneficial.

In particular, the spiral spool pipe designs may include using multilayer bonded or/and unbonded pipes, whereas different layers may have differing construction and differing purpose including, strength, torsional flexibility, pressure containment, corrosion protection, etc.

Figure 3A:
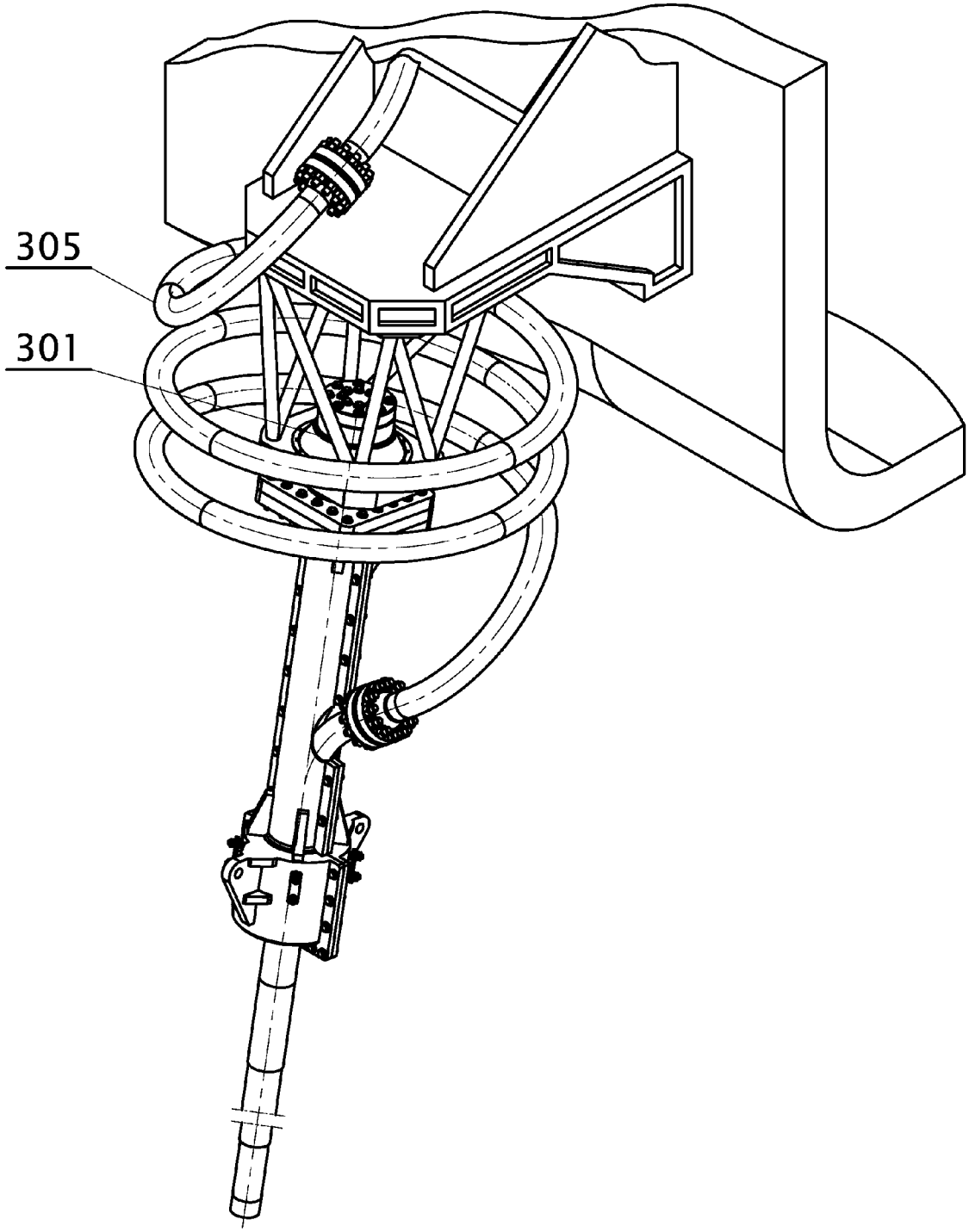
FIG. 3*a* features a circular spiral spool and FIG. 3*b* features a quadrangular spiral spool.
Figure 3B:
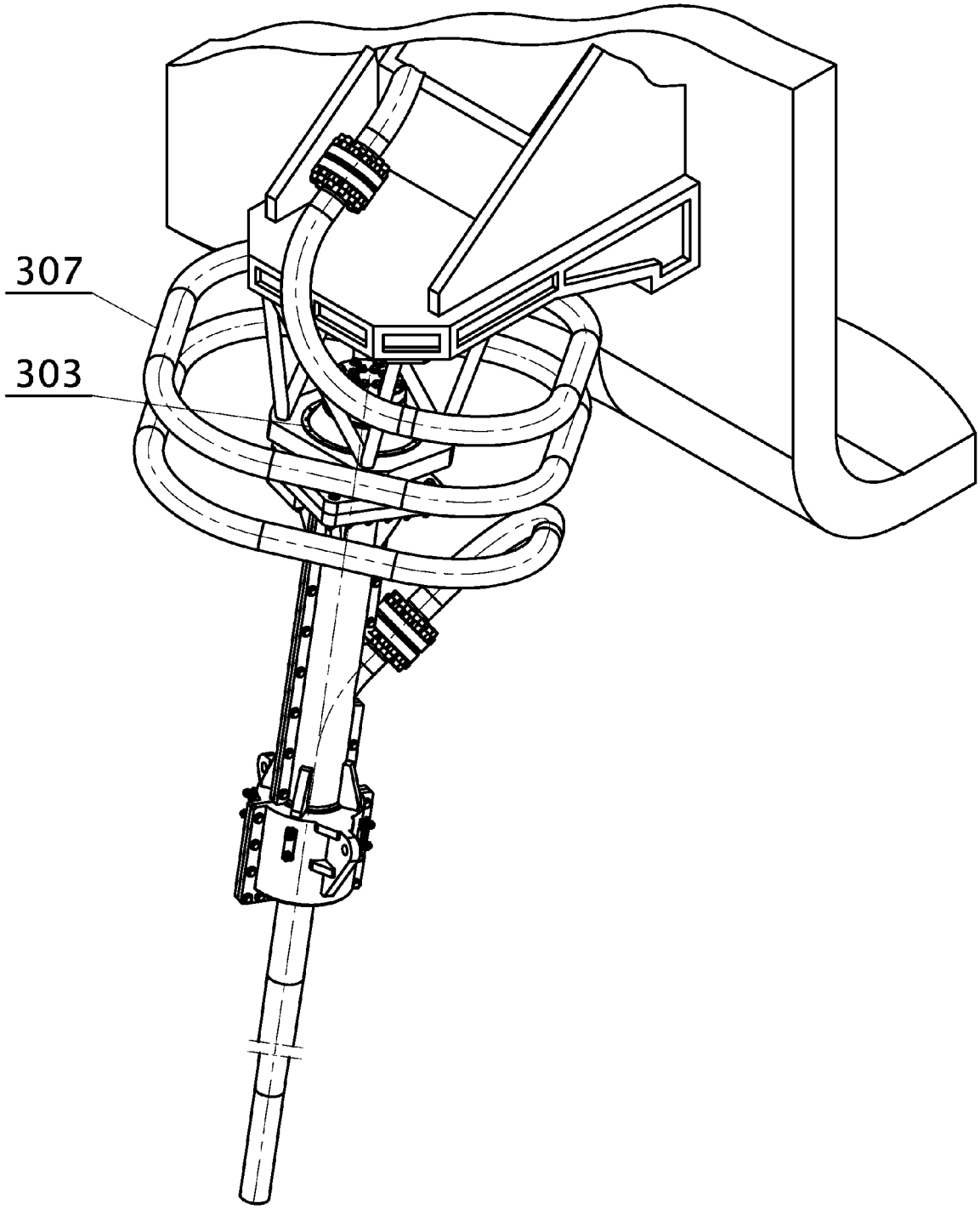
FIG. 3 depicts pivot-spool arrangements featuring flexjoints located close to the centers of progressive spirals.

FIG. 3 depicts a pivot-spool arrangement featuring flexjoints 301 and 303 located close to the centers of progressive spirals. FIG. 3*a* features a circular spiral spool 305 and FIG. 3*b* features a quadrangular spiral spool 307.

Flexjoints 301 and 303 used as pivots in designs according to this invention do not contain internal fluid pressure like it is shown for example in U.S. Pat. No. 5,269,629. Accordingly, unlike the designs shown for example by Langner, flexjoints can be successfully utilized in the designs according to this invention with no internal pressure limitations. It is noted that wide variety of flexjoint designs can be used successfully in designs according to this invention and that they can differ in many details from those illustrated for example only in FIGS. 3*a* and 3*b*.

In particular, the said flexjoints used in designs according to this invention can be more compact, can be designed to be more flexible in bending than conventional SCR flexjoints are and they can allow greater maximum bending angles.

Construction and design considerations related to those implementations of this invention that are depicted in FIGS.

3*a* and 3*b* and those of wide ranges of similar designs will be readily deduced by those skilled in the field on the basis of the detailed descriptions of designs depicted in FIGS. 2*a* and 2*b* and considerations highlighted herein.

Figure 4A:
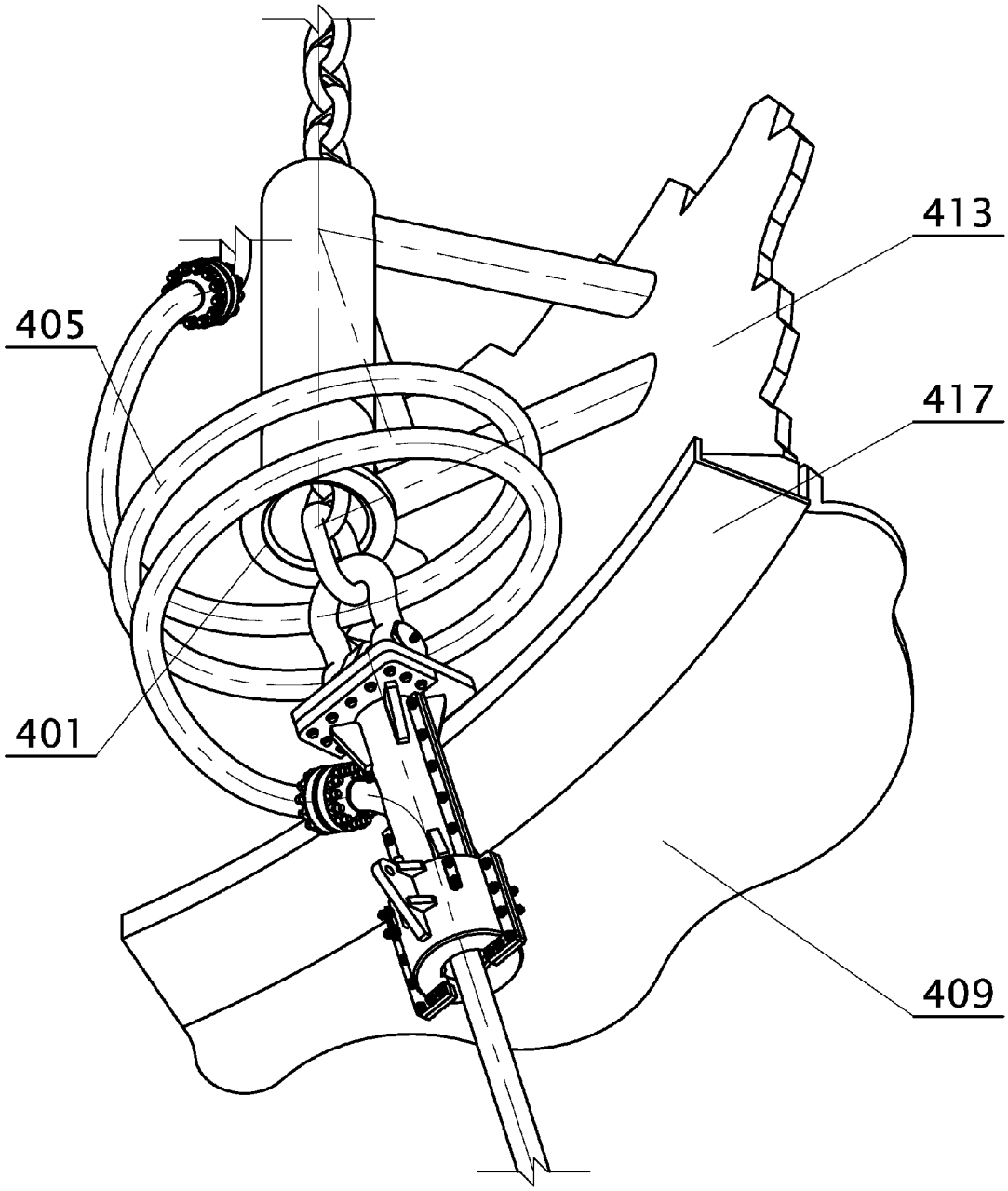
FIG. 4*a* features a circular spiral spool and FIG. 4*b* features a quadrangular spiral spool.
Figure 4B:
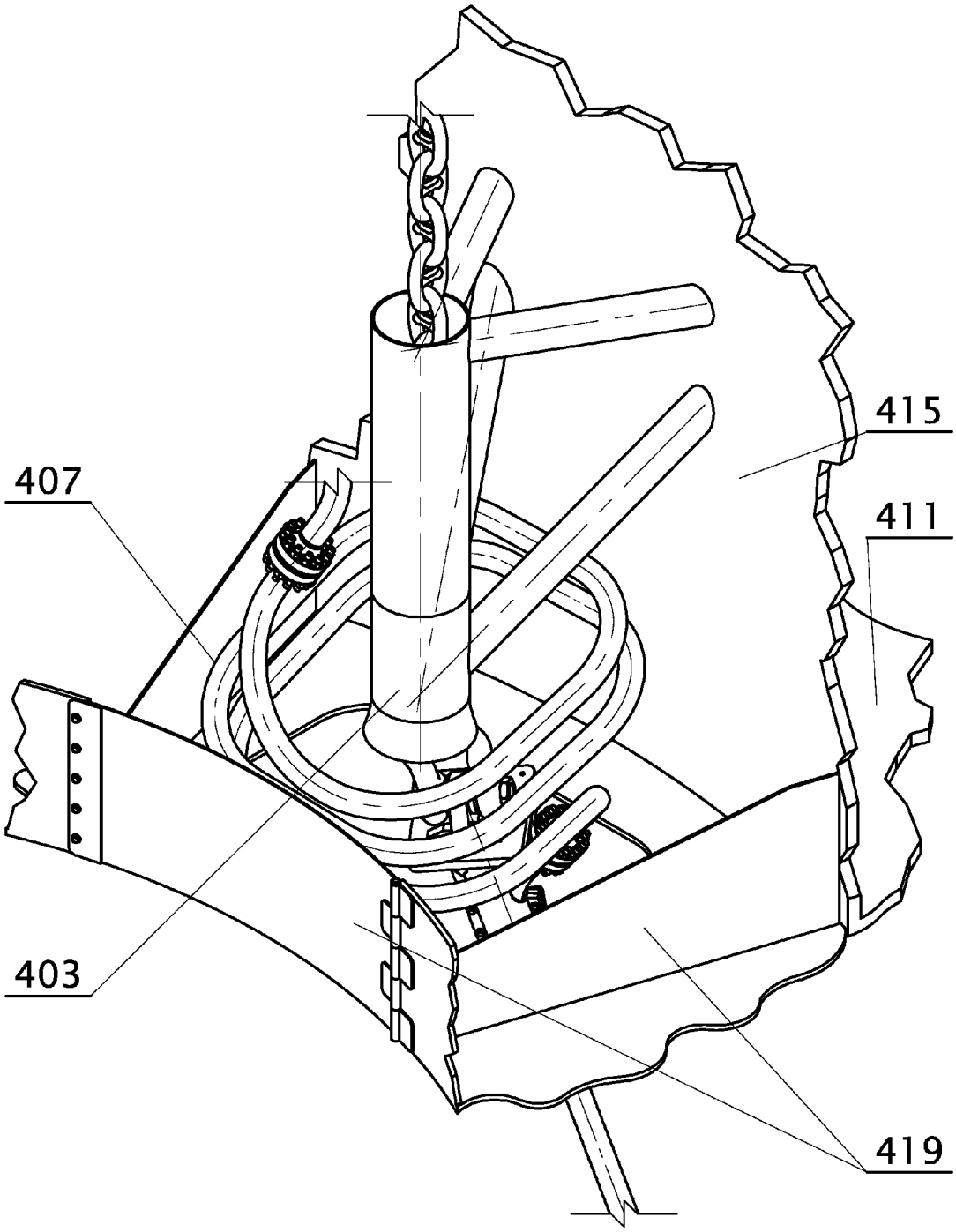
FIG. 4 depicts pivot-spool arrangements utilizing hawse pipes as pivots that are located close to the centers of progressive spirals.

FIG. 4 depicts pivot-spool arrangements utilizing hawse pipe entries 401 and 403 as pivots that are located close to the centers of progressive spirals 405 and 407. FIG. 4*a* features a circular spiral spool 405 and FIG. 4*b* features a quadrangular spiral spool 407.

The said spirals depicted in FIGS. 4*a* and 4*b* feature examples of placing the spiral assembly in locations that are sheltered from hydrodynamic loads, like for example those due to the actions of waves, currents and/or relative motions of the supporting structure through the water. Any of the coiled pipes arrangements according to this invention and/or adjacent components featured herein can be shielded from hydrodynamic loads due to VIV, drag and/or inertia forces, etc. by placing them in a convenient sheltered, shielded or partly shielded location relative the supporting structure or/and by providing specially designed shields. The detailed arrangements of the said shields would depend on the degree of sheltering or shielding required, on the position of the riser hang-off and the type of the supporting structure. The sheltering of shielding from hydrodynamic action can be applied to any extent preferred together with any implementation of this invention.

For example FIGS. 4*a* and 4*b* depict keel ends of a floater 409 and 411. The said coils 405 and 407 are sheltered in floater moonpools or specially arranged shafts 413 and 415. Optional shielding surfaces 417 and 419 are depicted in FIGS. 4*a* and 4*b*. Shielding structures 417 and 419 can extend in any direction, if required and can provide sheltering or shielding from any side. In particular, shielding structures can surround completely any coiled assembly according to this invention. The said shielding structures can be arranged totally inside the outlines of any supporting structure, totally outside the said outlines or/and partly inside and partly outside the said outlines. Part of the shielding structure 419 shown in FIG. 4*b* is optionally hinged for ease of installation.

Any type of said supporting structure can be utilized for said shielding and/or sheltering. Supporting structures like 409 and 411 featured in FIGS. 4*a* and 4*b* could for example represent keel fragments of keel regions of a spar, a TLP, a semi submersible or any other floater. Said coiled riser hang-off assembly can be located near to the sides of said moonpools or shafts, or they can be located away from those sides (internally or externally with regard to the outline(s) of the said structures), if necessary, as governed by of any design requirements, functional requirements, available space requirements or/and any kind or requirements or preferences whatsoever.

Construction and design considerations related to those implementations of this invention that are depicted in FIGS. 4*a* and 4*b* and those of wide ranges of similar designs will be routine for those skilled in the field on the basis of the detailed descriptions of designs depicted in FIGS. 2*a* and 2*b* and considerations highlighted herein.

FIG. 5 depicts a pivot-spool arrangement utilizing J-tube entries or I-tube entries as pivots located close to the centers of progressive spirals. The said J-tube is annotated as 501 and the said I-tube is annotated 503.

Figure 5A:
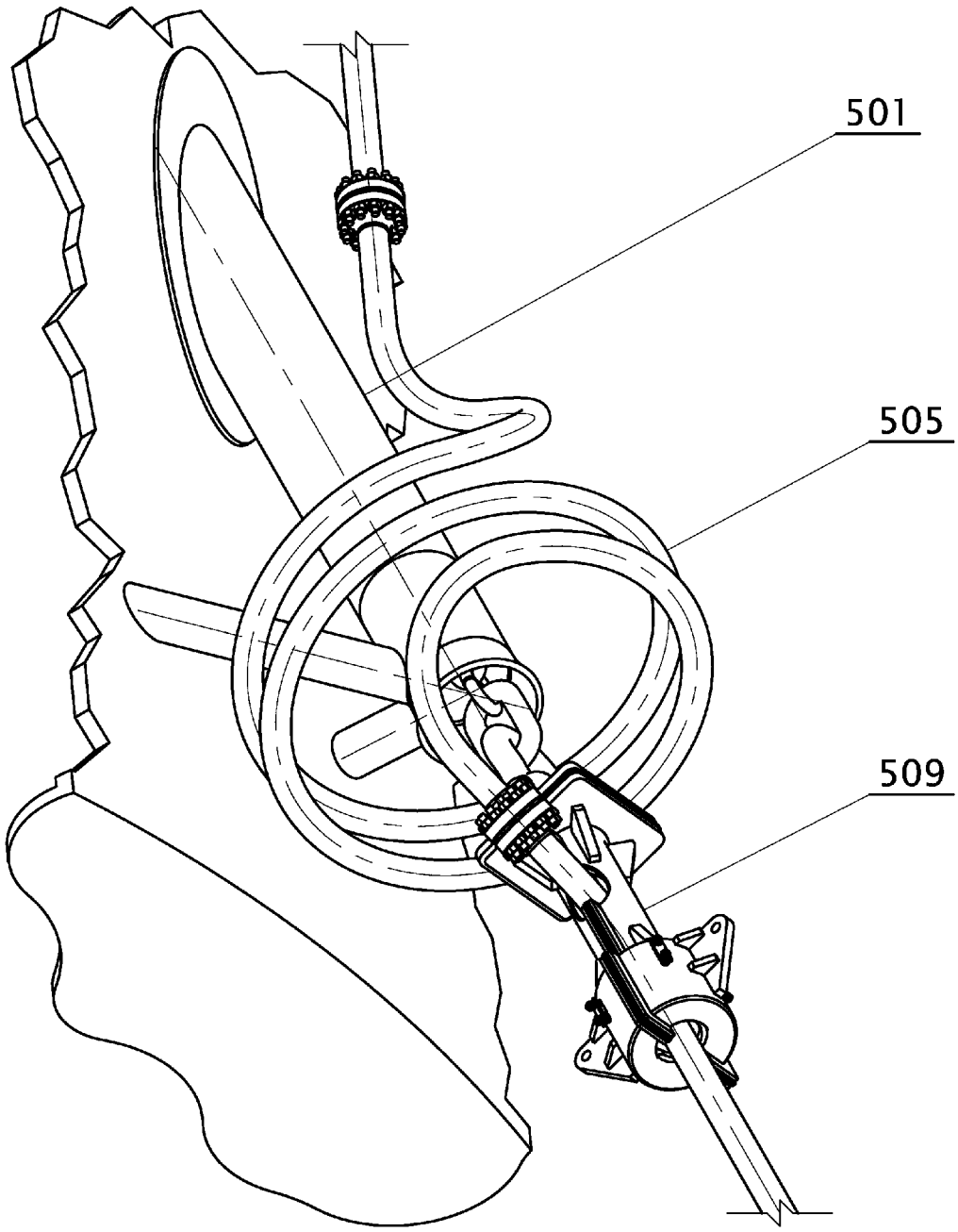
FIG. 5*a* features a circular spiral spool and FIG. 5*b* features a quadrangular spiral spool.
Figure 5B:
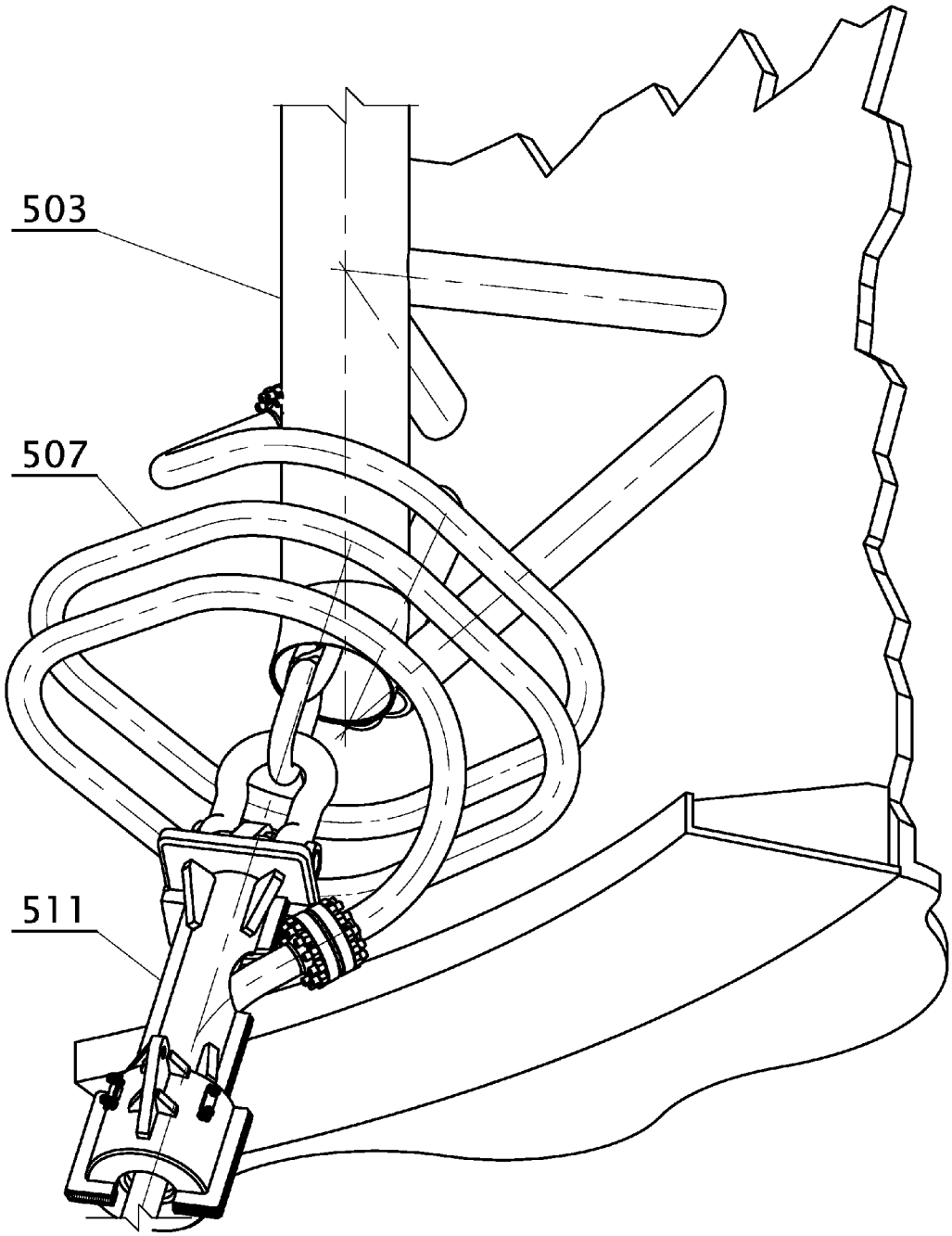
FIG. 5 depicts pivot-spool arrangements utilizing I-tube entries or J-tube entries as pivots located close to the centers of progressive spirals.

FIG. 5*a* features a circular spiral spool 505 and FIG. 5*b* features a quadrangular spiral spool 507. The J-tubes or I-tubes can be utilized for example on a spar platform or on any other type of a platform, vessel or buoy. It is noted that, similar to FIGS. 4*a* and 4*b*, the examplary implementation of this invention depicted in FIG. 5*b* features an optional structure shielding spool 507 from waves and currents.

It is also noted that in the example implementations of this invention depicted in FIGS. 5*a* and 5*b* the hang-off clamps 509 and 511 shown feature components that are welded together utilizing full penetration welds. In particular both the half-shells of 509 and 511 as well as the hang-off pad-eye plate attachments featured in the said examples are welded, rather than bolted together. Bolting and welding, as well as bolting only would also be acceptable in these and any similar implementations of this invention.

Construction and design considerations related to those implementations of this invention that are depicted in FIGS. 5*a* and 5*b* and those of wide ranges of similar designs will be routine for those skilled in the field on the basis of the detailed descriptions of designs depicted in FIGS. 2*a* and 2*b* and considerations highlighted herein.

Figure 6A:
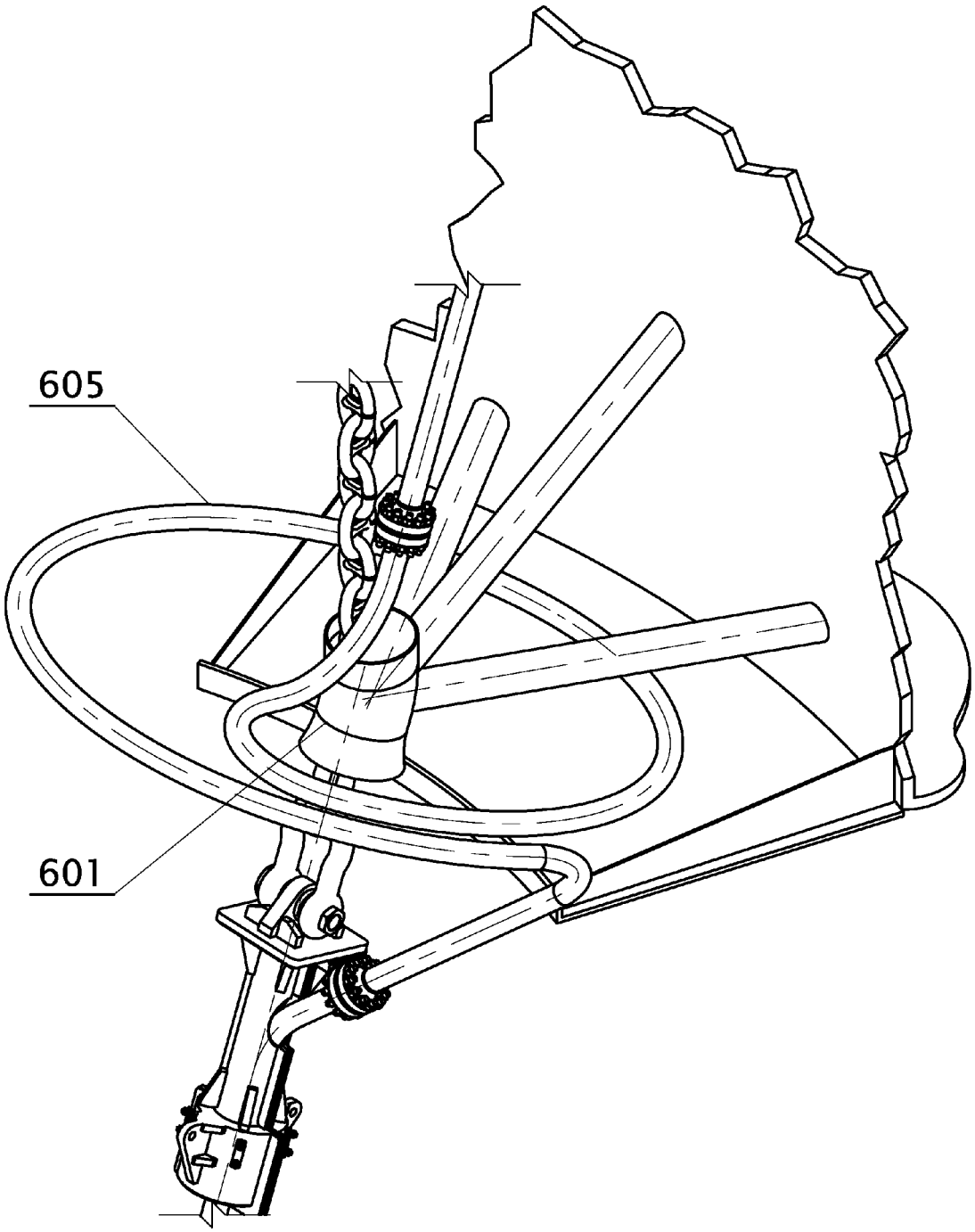
FIG. 6*a* features a circular spiral spool and FIG. 6*b* features a quadrangular spiral spool.
Figure 6B:
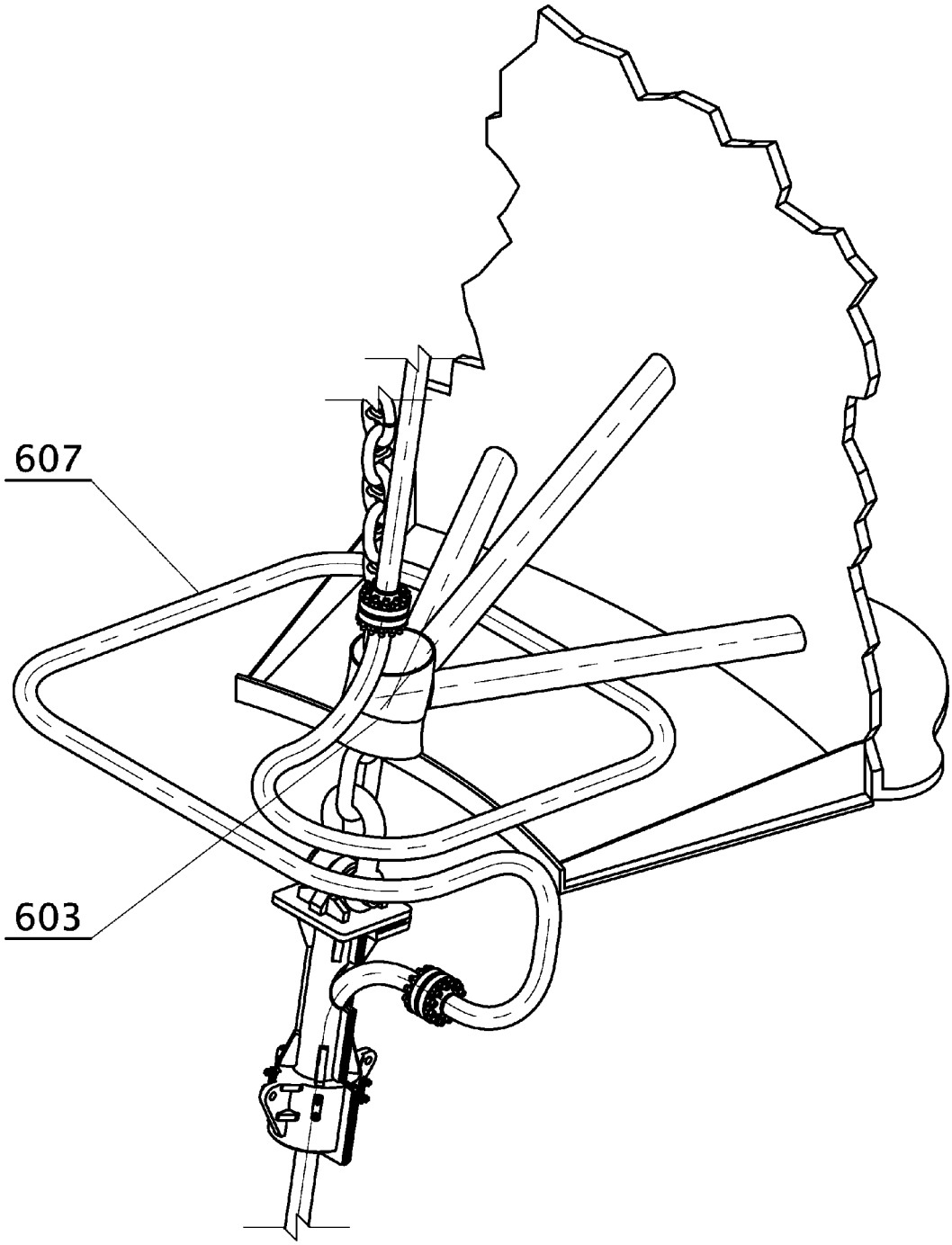
FIG. 6 depicts pivot-spool arrangements utilizing bell-mouths as pivots located close to the centers of planar (flat) spirals.

FIG. 6 depicts a pivot-spool arrangement utilizing bell-mouths 601 and 603 as a pivots located close to the centers of planar (flat) spirals. FIG. 6*a* features a circular spiral spool 605 and FIG. 6*b* features a quadrangular spiral spool 607.

As it has already been noted planar spiral spools tend to be more structurally efficient than designs utilizing progressive spiral geometries. Accordingly, in addition to spirals featuring more than 360° loops, like those shown in FIGS. 6*a* and 6*b*, loops featuring smaller loop angles, in particular angles smaller than 360° can be used in designs according to this invention, depending on the range of limiting design ranges of in-plane and out-of-plane angles $\Delta\theta$ (including $\Delta\theta 1$ and $\Delta\theta 2$), spool materials used (including FRP and other complex designs) and according to the spool geometry, lateral dimensions included. The said spool shapes featuring loop angles smaller than 360°, include in particular 'C'-shaped, 'L'-shaped spools, etc. These do not need to be arranged exactly in the planes orthogonal to the SCR axes at or close to the hang-offs like those represented for example by the bell-mouths 601 and 603.

Construction and design considerations related to those implementations of this invention that are depicted in FIGS. 6*a* and 6*b* and those of wide ranges of similar designs will be routine for those skilled in the field on the basis of the detailed descriptions of designs depicted in FIGS. 2*a* and 2*b* and considerations highlighted herein.

It is also noted that some pivot arrangements that utilize chain, connection links and shackles, like those featured for example in FIGS. 4 through 6 and FIGS. 11*e* and 11*f* need to be designed very carefully and high design factors or component load resistance (including bending, impact abrasion, corrosion, fatigue, etc. resistance) need to be applied in the design of those components that are continuously and/or repeatedly subjected to high structural, fatigue, etc. loads. In design implementations like those featured for example in FIGS. 4 through 6 single links happen to be subjected to such high loadings, which may include both in-plane and out-of-plane bending. In particular in-plane bending is a common type of bending of chain link or connection link material, but a combination of in-plane and out-of plane bending also combined with associated shear, including torsional shear is somewhat unusual in engineering and it needs to be accounted for in the design of such systems.

On the other hand design implementations of this invention like those featured for example in FIGS. 4 through 6 and in FIGS. 11*e* and 11*f* do present some simplicity and cost effectiveness advantages, both on the construction engineering and on the installation engineering sides. It is noted, that in addition to the said careful design consideration of the said high loads it is recommended to utilize said simple and cost effective design solutions for those SCR systems that tend to be less highly loaded (smaller diameter SCRs, SCR systems utilizing higher buoyancies and/or high degrees of thermal insulation, etc.) Detailed design and installation implications and considerations related to those and similar designs to these highlighted in this paragraph will be routine for those skilled in the field.

It is also noted, that for higher loaded designs like those similar to those featured for example in FIGS. 4 through 6, any kinds of pivots including ball joints, flexjoints, universal joints, etc. can be utilized instead of highly loaded links like those depicted on the said figures. The 'fixed' parts of the said ball joints, flexjoints, universal joints, etc. can be fitted, latched, clamped, etc. at the exits of the hawse pipes, I-tubes, J-tubes, bellmouths, and/or other arrangements having similar functional purpose, etc. Receptacle baskets or/and subsea connectors can be utilized for that purpose as well, in particular collet connectors. During the installations the SCR hang-off assemblies can be pulled to their design locations using chain, wire, coiled tubing, etc. and fixed, clamped or/and latched in place. Following the said fixing, clamping or/and latching of the fixed part of the pivoting-hang-off assembly, the chain, wire, coiled tubing, etc. that was required for installation can be detached and removed or either the whole of it or a lower part of it can be retained in place as optional secondary (back-up) attachment means. The upper parts of the said I-tubes, J-tubes etc. can be optionally utilized to contain platform piping pertaining to the riser in question, other risers, umbilicals, etc. Platform piping can also be lead outside said I-tubes, J-tubes, hawse pipes, etc. Design solutions like those described above are common in subsea engineering and further details are within the routine expertise of those skilled in the field.

FIG. 7 depicts a pivot-spool arrangement utilizing universal joints 701, 703 and 705 as pivots located close to the centers of spirals. FIG. 7*a* features a triangular spiral spool 707 and FIG. 7*b* features a pyramidal spiral spool 709 with the pyramid shape narrowing upwards. FIG. 7*c* features a pyramidal spiral spool 711 with the pyramid shape narrowing downwards.

Use of triangular spiral spools, rather than other shapes can be advantageous where for example two riser hang-offs need to be located close to each other. For a comparable torsional flexibility of a spiral spool, a spool similar to 707 can be designed to feature a smaller minimum lateral distance 713 between the center axis of the spring 715 and the center of a spool pipe cross section 717 than those that are possible for circular spools or other than triangular polygonal spool geometries.

Also, for those designs, where relatively large maximum lateral extents (radii) of spirals 719 are acceptable, triangular spools can feature greater tube lengths per spiral turn than those spool designs that are based on higher side number polygons, like for example quadrangles (including squares, rectangles and trapezoids), pentagons, etc. For the smallest possible maximum lateral dimensions, like for example 719, this practical advantage is lost, because the tube lengths of all regular polygon-based spirals tend to the similar length of a circular spiral as the maximum spiral radius 719 approaches XD (say 5D), the lengths of the straight tubular segments tend to zero and the spiral geometry progressively better approximates a regular helix (i.e. a circular progressive spiral).

Use of pyramidal spiral designs, like those for example illustrated as 709 and/or 711 can be advantageous for example depending on installation considerations and/or requirements for improved access to the SCR hang-off assembly or/and to the pivot units like for example 701, 703 or 705. Other advantages of the said pyramidal, conical and similar spool geometries can include:

- Staggering the spool geometry in the lateral direction (due to the slope of the pyramid or the apex angle of a cone, etc.), so that spiral turns are less likely to come in contact with each other as the spiral deforms under loads (angular deflection of the riser or/and submerged weight of the spiral),
- Optimization of the length and weight of the spiral-spool turns closer to the riser end of the spiral and to the spiral entry spools are more effective in 'absorbing' the angular deflections of the SCR, than turns lying farther away from the riser (i.e. upstream on an export riser).

FIGS. 7*a* through 7*c* feature optional examples of use of optional collet connectors 721, 723 and 725 used for the principal structural subsea joints made offshore during the installations of the example systems featured. Connectors can be also optionally used on one or both ends of spiral spools, as well as in any other optional locations, as it has already been mentioned herein.

Construction and design considerations related to those implementations of this invention that are depicted in FIGS. 7*a* through 7*c* and those of wide ranges of similar designs will be routine to those skilled in the field on the basis of the detailed descriptions of designs depicted in FIGS. 2*a* and 2*b* and considerations highlighted herein.

FIG. 8 depicts a pivot-spool arrangement utilizing a flexjoint 801 located above the center of planar (flat) spiral. FIG. 8 features a circular spiral spool 803 supported with a 4 leg beam support frame 805. In the optional example depicted beam support frame 805 is pivoted on the riser hang-off assembly utilizing universal joint 807.

The optional support (spider) beam structures shown in FIG. 8 can have multiple purposes, for example:

- Provide sliding structural supports to parts of the spiral in order to decrease self-weight/buoyancy generated stresses due to the submerged weight/positive buoyancy of the spool tube,
- Provide sliding structural supports to the spiral at preselected locations of the tube in order to modify the eigenfrequencies of the spiral spools 803 as the suspended pipe length span control for VIV control means,
- Provide sliding structural supports in order to control the spatial regions occupied by the spools in order to prevent their interference with other equipment, etc.

The sliding support frame can be pivoted at location 807, like is the spider frame shown in FIG. 8. The said frame can be also rigidly or flexibly supported from the stress joint or transition joint of the SCR, it can be rigidly or flexibly supported from the floater (using springs, using elastic bungies, catenary lines, etc.).

Beam spider supports featuring any arbitrary numbers of support legs can be used. In particular, whenever a pivoted or flexible support is used it is beneficial to utilize 3-leg spider support frames, because of the advantages of three-point supports in 3-D. Three-point supports tend to be effective in relieving self-weight stresses and providing reliable (also self-adjustable, if pivoted) span supports.

FIG. 8 shows for example purposes only a spider frame support 805 that supports the spiral spool at selected optional locations, whereas every other spool turn is supported by spider beams at optional locations. In the design shown there is no spool-support beam contact at locations between the optional sliding support locations.

A wide range of solutions for the design of optional fixed or movable spool support structures can be implemented. These can provide structural support to any kind of spiral spools that can feature planar or progressive spirals. Greater than one numbers of spool support structures that may be pivoted or fixed can be used to support a single spiral spool, whenever it is necessary or beneficial.

Construction and design considerations related to implementations of this invention that are similar to that depicted in FIG. 8 will be routine for those skilled in the field on the basis of the detailed descriptions of designs depicted in FIGS. 2*a* and 2*b* and other considerations highlighted herein.

FIG. 9 depicts pivot 901 and 903-spool 905 and 907 arrangements featuring progressive spirals 905 and 907 offset to locations above the said pivots. FIG. 9*a* features a ball joint 901 and a circular spiral spool 905 and FIG. 9*b* features a flexjoint 903 and a quadrangular spiral spool 907. For the sake of example platform piping in FIG. 9 is attached to semi submersible or TLP columns 909 and 911.

A qualification related to design examples depicted in FIGS. 9*a* and 9*b* is that vertical offsetting of the spool center locations with regard to the locations of the pivots is that often higher stressing of the spools results, or larger spiral dimensions and/or greater number of spiral loops and/or higher strength materials might be required in designs like those presented in FIGS. 9*a* and 9*b* than on better stress-optimized designs. The said qualification might be less relevant, or it might not apply or they not apply in cases where high torsional flexibility materials or high torsional flexibility section constructions are used.

The lateral and/or longitudinal offsets of the spiral spools (with regard to the SCR axis and in particular with regard to the hang-off pivot locations) allow the engineer more flexibility in the equipment design. Selections of offset spool locations can be made for reasons of ease of installation, ease of equipment access, ease of spatial arrangement, including staggering of equipment with regard to other equipment, etc.

Construction and design considerations related to those implementations of this invention that are depicted in FIGS. 9*a* and 9*b* and those of wide ranges of similar designs will be routine for those skilled in the field on the basis of the detailed descriptions of designs depicted in FIGS. 2*a* and 2*b* and considerations highlighted herein.

FIG. 10 depicts a pivot-spool arrangement featuring ball joints 1001 and 1003 and progressive spirals 1005 and 1007 offset approximately horizontally with regard to the location of the pivots 1009 and 1011. FIG. 10*a* features a circular spiral spool and FIG. 10*b* features a triangular spiral spool.

FIG. 10*a* depicts the riser hang-off assembly optionally sheltered from the action of waves and currents inside turret 1013 of an FPSO or FSO vessel. Riser hang-off clamp 1021 is attached to ball joint 1001 utilizing optional collet connector 1017.

FIG. 10*b* depicts the riser hang-off assembly including the spiral located outside turret 1015 of an FPSO or FSO vessel. The said riser hang-off assembly utilizes a tapered receptacle basket 1019, which in the design implementation featured, is used during the system installation as the 'principal' structural offshore subsea connection. By using the word 'principal' it is meant that said basket 1019 has, for the example design shown in FIG. 10*b*, a similar role from the system installation point of view, to that of connector 1017 depicted in FIG. 10*a*. In a case spirals 1005, 1007 needed sheltering from waves and currents, optional shielding structures (not shown) would be arranged around the said spirals and they would typically be suspended from the said turrets.

Similar considerations to those highlighted already with regard to designs shown for example in FIGS. 9*a* and 9*b* apply. However, spatial arrangement of equipment inside or close to a turret can be particularly challenging because of the vicinity of other risers, mooring lines, etc. and/or because of space limitations inside a turret.

Construction and design considerations related to those implementations of this invention that are depicted in FIGS. 10*a* and 10*b* and those of wide ranges of similar designs will be routine for those skilled in the field on the basis of the detailed descriptions of designs depicted in FIGS. 2*a* and 2*b* and considerations highlighted herein.

FIG. 11 depicts example details of a design of an SCR hang-off clamp assembly 1101 that is similar to those utilized in the designs depicted in FIGS. 2 through 10. Additional design details are also shown in FIG. 11.

FIG. 11*a* depicts an example SCR stress joint 1103-gooseneck 1105 arrangement. FIG. 11*a* also depicts an example hang-off clamp design 1107 utilizing a ball joint assembly 1109 as a pivoting arrangement.

FIG. 11*b* depicts an example pivoting arrangement utilizing a ball joint assembly 1109.

The said ball joint example shown is an example only and details of any ball joint design are immaterial to the matter of this invention. The exploded assembly design shown features for example a meridionally split body 1111, 1113 that is assembled utilizing optional locating pins 1115 and 1117. Optional fixed spherical bushing surfaces 1119 and optional adjustable spherical bushing surfaces 1121 are shown. The assemblies can be welded or optionally bolted together using cover flanges 1123 and 1125 and optional stud bolts 1127 and 1129. The ball joint body and the cover flanges can be provided with optional strengthening ribs 1131, 1133 and/or 1135.

The external parts of the said ball joint assembly 1109 can be optionally shaped to fit a receptacle basket similar to that shown for example as 1019 in FIG. 10*b*. As it has already been noted, the optional bolted connection such as that depicted in FIG. 11*a* between hang-off clamp 1101 and ball joint assembly 1111, 1113 might preferably be replaced with a bolted and welded connection or it might optionally be replaced with an optional subsea connector.

The ball assembly 1137 can be attached to riser porch 1139 utilizing optional centering pins 1141 and 1143, optional bolt or optional studs 1145 or it can be preferably landed inside the said receptacle basket that is structurally incorporated into or attached to the said porch. Optionally, ball assembly 1137 can be welded, or otherwise attached permanently, to any riser support structure utilized.

FIG. 11*c* depicts an examplary flexjoint assembly 1147 connected to a hang-off clamp. Optional high load bolted flange 1148 is depicted in FIG. 11*c*, but for most applications use of full penetration butt welds instead of bolts, etc. would be preferable. An optional connector could be optionally used instead of direct welding.

It is noted with regard to the flexjoint design depicted in FIG. 11*c* that the transmission of all the loads, including the axial and shear forces, relies on the elastomeric material utilized. This arrangement is common with some flexjoint designs (example TLP tendon flexjoints), but SCR flexjoints often incorporate a ball joint in their design, whereas the load path of the axial and shear loading of the entire unit is through the said ball joint. It is understood herein that either of the said types of flexjoints can be used as a pivoting arrangement in design implementations of this invention. Detailed design issues related to the said types of flexjoints, including those highlighted herein are known to those skilled in the field.

FIG. 11*d* depicts an example hang-off clamp 1151 design utilizing a universal joint 1153.

FIG. 11*e* depicts an example hang-off clamp 1155 design utilizing shackles 1157 and padeyes 1159 assembly.

FIG. 11*f* depicts an example assembly incorporating a hang-off clamp 1161, shackle 1163, padeye 1165 and chain 1167.

FIG. 11*g* depicts an example of a buoyancy clamp 1171 used on a pipe spool 1173.

FIG. 11*h* depicts an example of a helicoidal strake clamp 1175 used on a pipe spool 1173 to suppress VIVs.

Buoyancy clamps of a variety of designs, like those depicted for the sake of examples in FIGS. 11*g* and 11*h*, can be used on the equipment described herein for several reasons, in particular:

To reduce self weight loads on the piping due to the submerged weight together with the stresses and deformations corresponding, To improve locally thermal insulation of the piping, To increase locally the hydrodynamic diameter of the piping assembly and thus shift the frequencies of the VIV excitations, To suppress VIVs, To increase locally the hydrodynamic drag of the piping and to modify the added mass coefficient in order to modify the hydrodynamic and dynamic characteristics of the system, see PCT Patent Application PCT/US2005/046761 (Wajnikonis) which is hereby incorporated by reference in its entirety.

FIG. 11*i* depicts an example of bumper-support clamps 1177 used on a pipe spool 1173 to suppress VIVs and to support the submerged weight of parts of the spools. The details of the shapes of the said bumper-support clamps 1177 as well as the gaps between clamps 1177, their shapes, their buoyancies and sizes of the said bumper-support clamps 1177 used need to be optimized in the design process of any particular system. Bumper support clamps 1177 that are used in different locations on spools 1173 could be of different sizes, as featured as an example only in FIG. 11*i*, or they may be of the same size. In addition to the above bumper-support clamps 1177 may be provided with contact shoes (not shown), which may be used in order to adjust any gaps between components to values required.

The example of a bumper-support clamp depicted in FIG. 11*i* can have any combination of functional purposes in addition to those listed above. These may include in particular:

Providing discrete or continuous support to the piping in order to mechanically control the deflections of the equipment due to self weight and/or due to hydrodynamic loads in waves and currents, Providing discrete or continuous support locations to the piping in order to modify the eigenfrequencies of the system and thus control VIVs.

The nearly continuous or continuous supports can be achieved by using large numbers of said bumper support clamps installed densely on the piping.

Depending on the design requirements of a particular system, the said bumper clamps can be provided with loose or tight optional shape protrusions 1179 made of the same or of different materials, loose optional sling connections 1181 and/or 1183 etc. in order to mechanically tie spiral loops together (1179) and/or in order to more effectively anchor the system (1181, 1183) and thus effectively protect the system from the actions of currents and waves.

The shapes of the bumper clamps as well as the said optional protrusions and/or optional sling interconnections need to be designed so that the piping had sufficient capability to undergo torsional deformations as per the objectives of this invention.

It is noted hereby that combinations depicted in Figures utilized herein are examples only. In particular the combinations of any particular pivoting arrangements shown with those of any particular spiral spool arrangements shown and with any kind of structure or arrangement that suspends the spool/pivoting arrangements on any particular type of vessel, buoy, turret, etc are examples only and they can be freely interchanged without affecting the generality of this invention. Even more arrangement combinations can be designed according to this invention, which include spiral designs that are not depicted on the said figures (like L-shaped spirals, C-shaped spirals, etc.).

Although the invention has been described in detail with reference to certain preferred embodiments, variations and modifications exist within the scope and spirit of the invention as described and defined in the following claims.

What is claimed is:

1. A riser hanger comprising:

a support having means for attachment to a floating structure;

a pivot attached to the support;

a riser support collar having a first collar end attached to the pivot and a second collar end having means for engaging the upper end of a riser;

a fluid conduit in a generally coiled configuration consisting essentially of alternating, contiguous sections of curved pipe and straight pipe and having a first conduit end having means for fluid communication with the riser engaged in the collar and a second conduit end having means for connection to piping on the floating structure;

wherein the collar comprises an aperture sized and spaced to allow a gooseneck on the upper end of the riser engaged in the collar to pass through the aperture off-axis the collar and extend outside of the collar and connect to the first conduit end of the fluid conduit in a generally coiled configuration.

2. A riser hanger as recited in claim 1 wherein the pivot comprises a ball joint suspended from the support.

3. A riser hanger as recited in claim 1 wherein the pivot comprises a flexjoint.

4. A riser hanger as recited in claim 1 wherein the pivot comprises a hawse pipe, at least one chain link and at least one shackle.

5. A riser hanger as recited in claim 1 wherein the pivot comprises an I-tube, at least one chain link and at least one shackle.

6. A riser hanger as recited in claim 1 wherein the pivot comprises a j-tube, at least one chain link and at least one shackle.

7. A riser hanger as recited in claim 1 wherein the pivot comprises a bellmouth, at least one chain link and at least one shackle.

8. A riser hanger as recited in claim 1 wherein the pivot comprises a universal joint.

9. A riser hanger as recited in claim 1 wherein the pivot comprises at least one shackle and at least one padeye.

10. A riser hanger as recited in claim 1 wherein the fluid conduit is coiled about a substantially vertical axis that is laterally displaced from the longitudinal axis of the riser engaged in the collar.

11. A riser hanger as recited in claim 1 wherein the fluid conduit is configured in a quadrangular spiral.

12. A riser hanger as recited in claim 1 wherein the fluid conduit is configured in a pyramidal spiral with the pyramidal spiral narrowing in the downward direction when the riser hanger is attached to the floating structure.

13. A riser hanger as recited in claim 1 wherein the fluid conduit is configured in a pyramidal spiral with the pyramidal spiral narrowing in the upward direction when the riser hanger is attached to the floating structure.

14. A riser hanger as recited in claim 1 wherein the fluid conduit is coiled in a substantially planar configuration.

15. A riser hanger as recited in claim 1 wherein the support is configured for cantilevered attachment to the floating structure and the pivot is suspended from the support.

16. A riser hanger as recited in claim 1 wherein the fluid conduit has a fluid path that traverses at least 720 degrees around the pivot.

17. A riser hanger as recited in claim 1 wherein the pivot comprises a ball joint and the collar comprises a socket which is sized and configured to pivotally engage the ball joint.

18. A riser hanger as recited in claim 1 wherein the fluid conduit is configured in a coil having fluid entry and exit points that are vertically displaced above the center of rotation of the pivot when the riser hanger is installed on the floating structure.

19. A riser hanger as recited in claim 1 further comprising a shielding structure configured for attachment to the floating structure at a location which shields the fluid conduit from the action of waves and currents when the riser hanger is attached to the floating structure at the location that exposes the fluid conduit to the action of waves and currents.

20. A riser hanger as recited in claim 1 further comprising a shielding structure attached to the support at a location which shields the fluid conduit from the action of waves and currents when the riser hanger is attached to the floating structure at the location that exposes the fluid conduit to the action of waves and currents.

21. A riser hanger as recited in claim 14 further comprising a beam structure in sliding engagement with the fluid conduit and configured to restrict movement of the fluid conduit.

22. A riser hanger as recited in claim 21 further comprising a universal joint connecting the beam structure to the collar.

23. A riser hanger as recited in claim 1 wherein the fluid conduit is in a generally helical configuration and further comprising at least one bumper attached to a portion of the fluid conduit, said bumper sized and configured to prevent adjacent segments of the fluid conduit from contacting one another when the fluid conduit is displaced by a bending load.

24. A riser hanger as recited in claim 23 wherein the bumper provides positive buoyancy when submerged.

25. A riser hanger as recited in claim 1 further comprising helical strakes on at least a portion of the fluid conduit, said strakes sized and spaced to suppress vortex-inducted vibrations in the fluid conduit.

26. A riser hanger as recited in claim 1 wherein a plurality of the straight pipe sections are at least 50 percent longer than the adjacent curved pipe sections.

27. A riser hanger as recited in claim 1 wherein a plurality of the straight pipe sections are at least twice as long as the adjacent curved pipe sections.

28. A riser hanger comprising:

a support having means for attachment to a floating structure;

a pivot attached to the support;

a riser support collar having a first collar end attached to the pivot and a second collar end having means for engaging the upper end of a riser;

a fluid conduit in a generally coiled configuration consisting essentially of alternating, contiguous sections of curved pipe and straight pipe and having a first conduit end having means for fluid communication with the riser engaged in the collar and a second conduit end having means for connection to piping on the floating structure;

wherein the collar comprises two halves which are bolted together to engage the upper end of the riser and the upper end of the riser exits the collar off-axis.

29. A riser hanger comprising:

a support having means for attachment to a floating structure;

a pivot attached to the support;

a riser support collar having a first collar end attached to the pivot and a second collar end having means for engaging the upper end of a riser;

a fluid conduit in a generally coiled configuration consisting essentially of alternating, contiguous sections of curved pipe and straight pipe and having a first conduit end having means for fluid communication with the riser engaged in the collar and a second conduit end having means for connection to piping on the floating structure wherein the collar comprises two halves which are welded together to engage the upper end of the riser and the upper end of the riser exits the collar off-axis.

* * * * *